US011829093B2

(12) United States Patent
Inuzuka

(10) Patent No.: US 11,829,093 B2
(45) Date of Patent: *Nov. 28, 2023

(54) IMAGE FORMING APPARATUS WITH ENDLESS BELT, STRETCHING ROLLERS TO STRETCH ENDLESS BELT, AND POSITION CHANGING MECHANISM TO MOVE INNER ROLLER OF STRETCHING ROLLERS

(71) Applicant: CANON KABUSHIKI KAISHA, Tokyo (JP)

(72) Inventor: Tomoya Inuzuka, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/863,562

(22) Filed: Jul. 13, 2022

(65) Prior Publication Data

US 2022/0350287 A1 Nov. 3, 2022

Related U.S. Application Data

(62) Division of application No. 17/337,585, filed on Jun. 3, 2021, now Pat. No. 11,429,052.

(30) Foreign Application Priority Data

Jun. 18, 2020 (JP) ..... 2020-105704

(51) Int. Cl.

| | |
|---|---|
| ***G03G 15/00*** | (2006.01) |
| ***G03G 15/16*** | (2006.01) |
| *G03G 15/06* | (2006.01) |

(52) U.S. Cl.

CPC ..... *G03G 15/6558* (2013.01); *G03G 15/1605* (2013.01); *G03G 15/1615* (2013.01);

(Continued)

(58) Field of Classification Search

CPC ..... G03G 15/16; G03G 15/1605; G03G 15/1615; G03G 15/6558;

(Continued)

(56) References Cited

U.S. PATENT DOCUMENTS 4,032,137 A 6/1977 Katayama et al.
4,098,551 A 7/1978 Komori et al.

(Continued)

FOREIGN PATENT DOCUMENTS

CN 101371202 A 2/2009
CN 102759869 A 10/2012

(Continued)

OTHER PUBLICATIONS

Oct. 5, 2021 European Search Report in European Patent Appln. No. 21177373.4.

(Continued)

*Primary Examiner* — Joseph S Wong
(74) *Attorney, Agent, or Firm* — Venable LLP

(57) ABSTRACT

An image forming apparatus includes an image bearing member, an image forming portion, an endless belt, a plurality of stretching rollers including an inner roller, an outer roller, a position changing mechanism capable of changing a position of the inner roller to a first position and a second position positioned downstream of the first position with respect to a rotational direction of the endless belt, a feeding member, a feeding member driving portion, and a controller. A feeding start timing of a recording material by the feeding member depends on the position of the inner roller during transfer of a toner image onto the recording material.

27 Claims, 8 Drawing Sheets

(52) U.S. Cl.
CPC ... *G03G 15/06* (2013.01); *G03G 2215/00409* (2013.01); *G03G 2215/00556* (2013.01); *G03G 2215/00599* (2013.01); *G03G 2215/00603* (2013.01)

(58) Field of Classification Search
CPC ..... G03G 2215/00409; G03G 2215/00556; G03G 2215/00599; G03G 2215/00603
See application file for complete search history.

(56) References Cited

U.S. PATENT DOCUMENTS

| | | | | |
|---|---|---|---|---|
| 4,108,427 | A | 8/1978 | Komori et al. | |
| 4,538,902 | A | 9/1985 | Inuzuka et al. | |
| 4,563,079 | A | 1/1986 | Inuzuka et al. | |
| 4,707,111 | A | 11/1987 | Inuzuka et al. | |
| 4,740,671 | A | 4/1988 | Kuroda et al. | |
| 7,509,071 | B2 | 3/2009 | Yoshimura | |
| 8,797,600 | B2 | 8/2014 | Harashima | |
| 9,304,472 | B2 | 4/2016 | Ishikawa | |
| 11,429,052 | B2 * | 8/2022 | Inuzuka | G03G 15/1615 |
| 2007/0160388 | A1 | 7/2007 | Yoshimura | |
| 2011/0293303 | A1 | 12/2011 | Fujii | |
| 2012/0274986 | A1 | 11/2012 | Harashima | |
| 2012/0321329 | A1 | 12/2012 | Yoshida | |
| 2014/0161495 | A1 * | 6/2014 | Hatano | G03G 15/162 399/302 |
| 2014/0199089 | A1 | 7/2014 | Ishikawa | |
| 2017/0275111 | A1 * | 9/2017 | Nakajima | B65H 5/021 |
| 2017/0343944 | A1 * | 11/2017 | Matsuura | G03G 15/0189 |
| 2019/0265620 | A1 | 8/2019 | Kadowaki | |
| 2020/0198911 | A1 | 6/2020 | Watanabe | |
| 2021/0263450 | A1 | 8/2021 | Sakaguchi et al. | |
| 2021/0263459 | A1 | 8/2021 | Inuzuka | |

FOREIGN PATENT DOCUMENTS

| | | | |
|---|---|---|---|
| EP | 3872574 | A | 9/2021 |
| JP | 2006-145622 | A | 6/2006 |
| JP | 2010-113236 | A | 5/2010 |
| JP | 2014-134718 | A | 7/2014 |
| JP | 2019-120830 | A | 7/2019 |

OTHER PUBLICATIONS

Jul. 18, 2023 Chinese Official Action in Chinese Patent Appln. No. 202110675087.2.

* cited by examiner

IMAGE FORMING APPARATUS WITH ENDLESS BELT, STRETCHING ROLLERS TO STRETCH ENDLESS BELT, AND POSITION CHANGING MECHANISM TO MOVE INNER ROLLER OF STRETCHING ROLLERS

This application is a divisional of application Ser. No. 17/337,585 filed Jun. 3, 2021, U.S. Pat. No. 11,429,052 B2.

FIELD OF THE INVENTION AND RELATED ART

The present invention relates to an image forming apparatus for forming a toner image on a recording material.

Conventionally, as the image forming apparatus using the electrophotographic type, there is an image forming apparatus using an endless belt as an image bearing member for bearing a toner image. As such a belt, for example, there is an intermediary transfer belt used as a second image bearing member for feeding a sheet-like recording material such as paper from a photosensitive member or the like as a first image bearing member.

In the image forming apparatus using the intermediary transfer belt, a toner image formed on the photosensitive member or the like is primary-transferred onto the intermediary transfer belt at a primary transfer portion. Then, the toner image primary-transferred on the intermediary transfer belt is secondary-transferred onto the recording material at a secondary transfer portion. By an inner member (inner secondary transfer member) provided on an inner peripheral surface side and an outer member (outer secondary transfer member) provided on an outer peripheral surface side, a secondary transfer portion (secondary transfer nip) which is a contact portion between the intermediary transfer belt and the outer member is formed. As the inner member, an inner roller (inner secondary transfer roller) which is one of a plurality of stretching rollers for stretching the intermediary transfer belt is used. As the outer member, an outer roller (outer secondary transfer roller) which is provided in a position opposing the inner roller while nipping the intermediary transfer belt between itself and the inner roller and which is pressed toward the inner roller is used in many instances. Further, a secondary transfer voltage of a polarity opposite to a charge polarity of toner is applied to the outer roller (or a voltage of the same polarity as the charge polarity of the toner is applied to the inner roller), so that the toner image is secondary-transferred from the intermediary transfer belt onto the recording material in the secondary transfer portion. In general, with respect to a feeding direction of the recording material, on a side upstream of the secondary transfer portion, a feeding guide for guiding the recording material to the secondary transfer portion is provided. Incidentally, as regards the recording material, a "leading end" and a "trailing end" refer to those with respect to a recording material feeding direction.

Here, depending on rigidity of the recording material, behavior of the recording material changes in the neighborhoods of the secondary transfer portion on sides upstream and downstream of the secondary transfer portion with respect to the recording material feeding direction, and has an influence on an image which is a product in some instances.

For example, in the case where the recording material is "thin paper" which is an example of the recording material with small rigidity, in the neighborhood of the secondary transfer nip on the side downstream of the secondary transfer portion with respect to the recording material feeding direction, the intermediary transfer belt and the recording material stick to each other, so that a jam (paper jam) occurs in some instances due to improper separation of the recording material from the intermediary transfer belt.

On the other hand, in the case where the recording material is "thick paper" which is an example of the recording material with large rigidity, when a trailing end portion (trailing end or region close to the trailing end) of the recording material passes through the feeding guide, a tailing end portion of the recording material with respect to the recording material feeding direction collides with the intermediary transfer belt in some instances. By this, with respect to the recording material feeding direction, an attitude of the intermediary transfer belt in the neighborhood of the secondary transfer portion on the upstream side is disturbed, so that an image defect (a stripe-shaped image disturbance or the like extending in a direction substantially perpendicular to the recording material feeding direction) occurs at the trailing end portion of the recording material in some instances. In recent years, in a commercial printing market required to meet diversifying recording materials, these problems become apparent in many instances.

Therefore, a constitution in which a shape (position) of the secondary transfer portion is changed depending on a kind of the recording material has been proposed (Japanese Laid-Open Patent Application (JP-A) 2014-134718).

In order to realize improvement in separating property of the recording material from the intermediary transfer belt and suppression of the image defect at the trailing end portion of the recording material, as disclosed in JP-A 2014-134718, it is effective that the shape (position) of the secondary transfer portion is changed depending on the kind of the recording material. This change in shape (position) of the secondary transfer portion can be made by changing a relative position (represented by an "offset amount" described later) between the inner roller and the outer roller with respect to a circumferential direction of the inner roller through movement of the inner roller or the outer roller.

However, when the offset amount is changed depending on a kind of the recording material, at the same time, a position of the stretching roller for the intermediary transfer belt, typically, a position of a tension roller imparting tension to the intermediary transfer belt changes in a region from the primary transfer portion to the secondary transfer portion. When the position of the tension roller changes, a length from the primary transfer portion to the secondary transfer portion with respect to a rotational direction of the intermediary transfer belt also changes. As a result, a phenomenon such that timing when the image on the intermediary transfer belt is fed to the secondary transfer portion deviates and thus a leading end position of the image formed on the recording material deviates from a desired (original) position (herein, this phenomenon is also referred to as "leading end misregistration") occurs in some instances. When the leading end misregistration occurs, for example, there is a possibility that a leading end or a trailing end of the image protrudes from the recording material and that a printing position is out of an entry frame or overlaps with a frame line in the case where the image is printed in the entry frame pre-printed on a sheet or in the like case.

In the above, conventional problems were described taking, as an example, the secondary transfer portion which is a transfer portion of the toner image from the intermediary transfer belt onto the recording material, but there are similar problems also as to another transfer portion of the toner image from another belt-shaped image bearing member such as a photosensitive belt onto the recording material.

SUMMARY OF THE INVENTION

A principal object of the present invention is to provide an image forming apparatus capable of suppressing an occurrence of leading end misregistration due to a change in offset amount.

The object has been accomplished by the image forming apparatus according to the present invention.

According to an aspect of the present invention, there is provided an image forming apparatus comprising: an image bearing member configured to bear a toner image; an image forming portion configured to form the toner image on the image bearing member; an endless belt onto which the toner image formed on the image bearing member is transferred at a primary transfer portion; a plurality of stretching rollers including an inner roller and configured to stretch the endless belt; an outer roller configured to form a secondary transfer portion, in cooperation with the inner roller, where the toner image is transferred from the endless belt onto a recording material; a position changing mechanism configured to change a position of the secondary transfer portion with respect to a circumferential direction of the inner roller by moving the inner roller, wherein the position changing mechanism is capable of changing a position of the inner roller to a plurality of positions including a first position and a second position positioned downstream of the first position with respect to a rotational direction of the endless belt; a feeding member configured to feed the recording material to the secondary transfer portion; a feeding member driving portion configured to drive the feeding member; and a controller configured to control a feeding start timing of the recording material by the feeding member, wherein the feeding start timing of the recording material by the feeding member depends on the position of the inner roller during transfer of the toner image onto the recording material.

Further features of the present invention will become apparent from the following description of exemplary embodiments with reference to the attached drawings.

Figure 4:
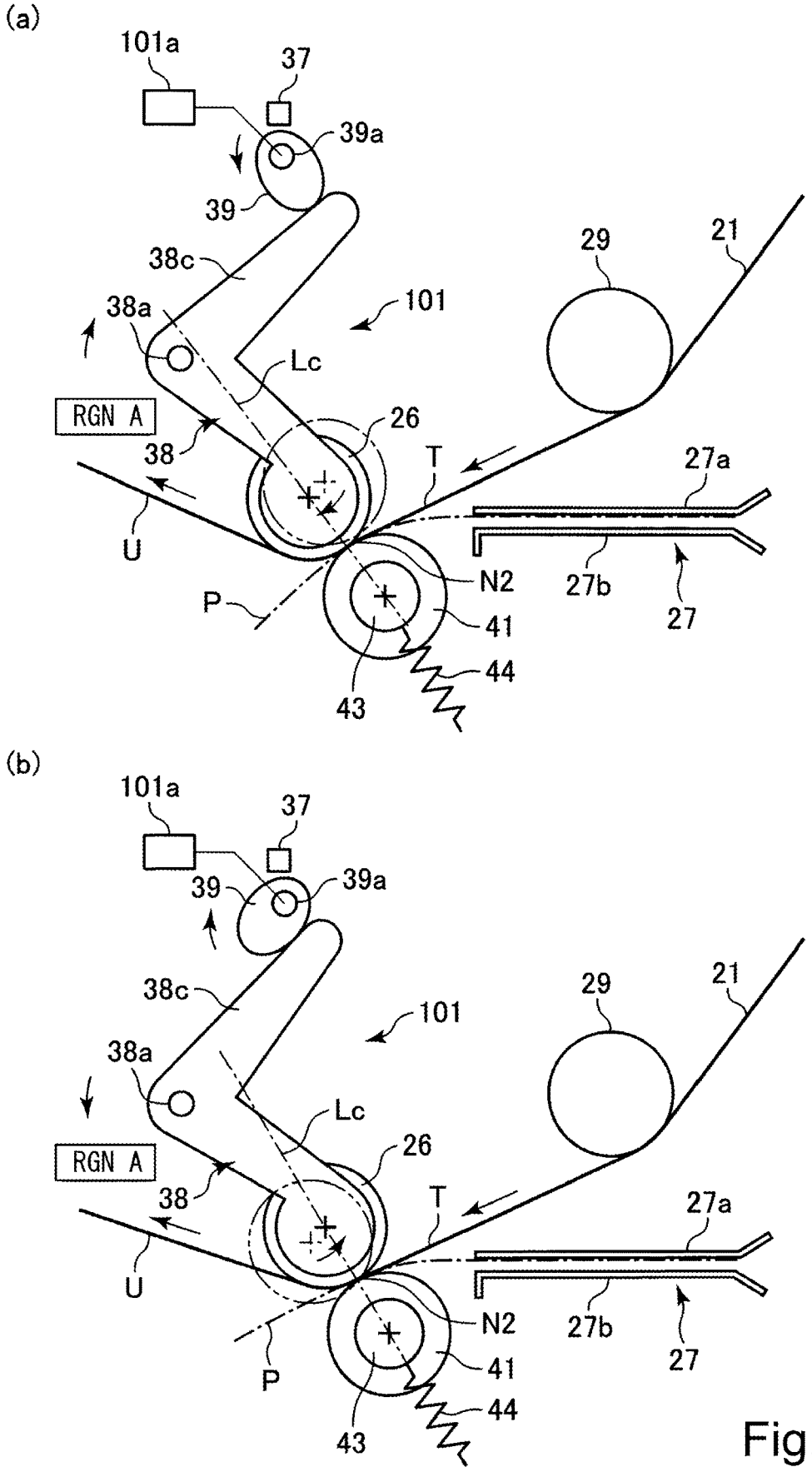

Parts (a) and (b) of FIG. 4 are schematic side views each showing an offset mechanism.

Figure 5:
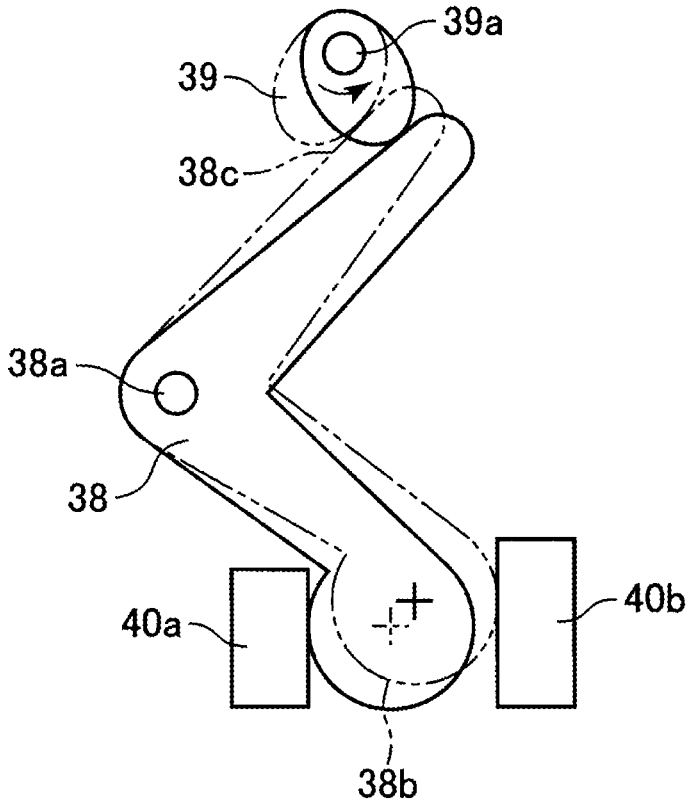

FIG. 5 is a schematic side view showing a part of the offset mechanism.

Figure 6:
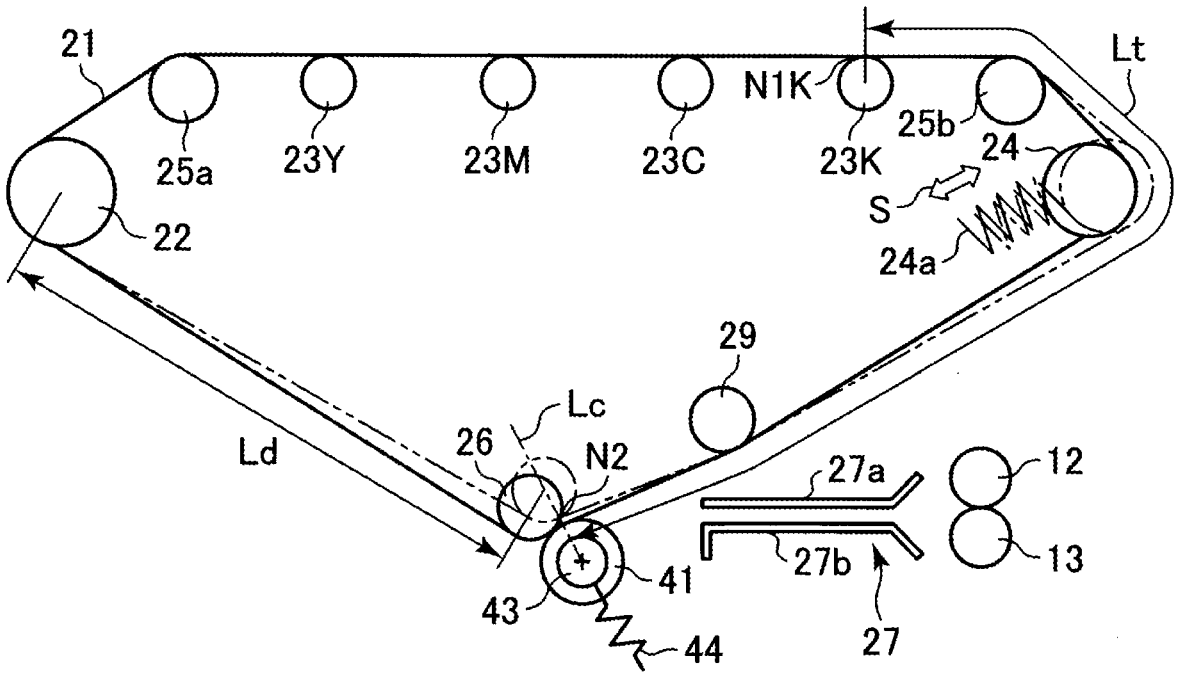

FIG. 6 is a schematic sectional view for illustrating an example of a relationship between an offset amount and a stretched state of an intermediary transfer belt.

Figure 7:
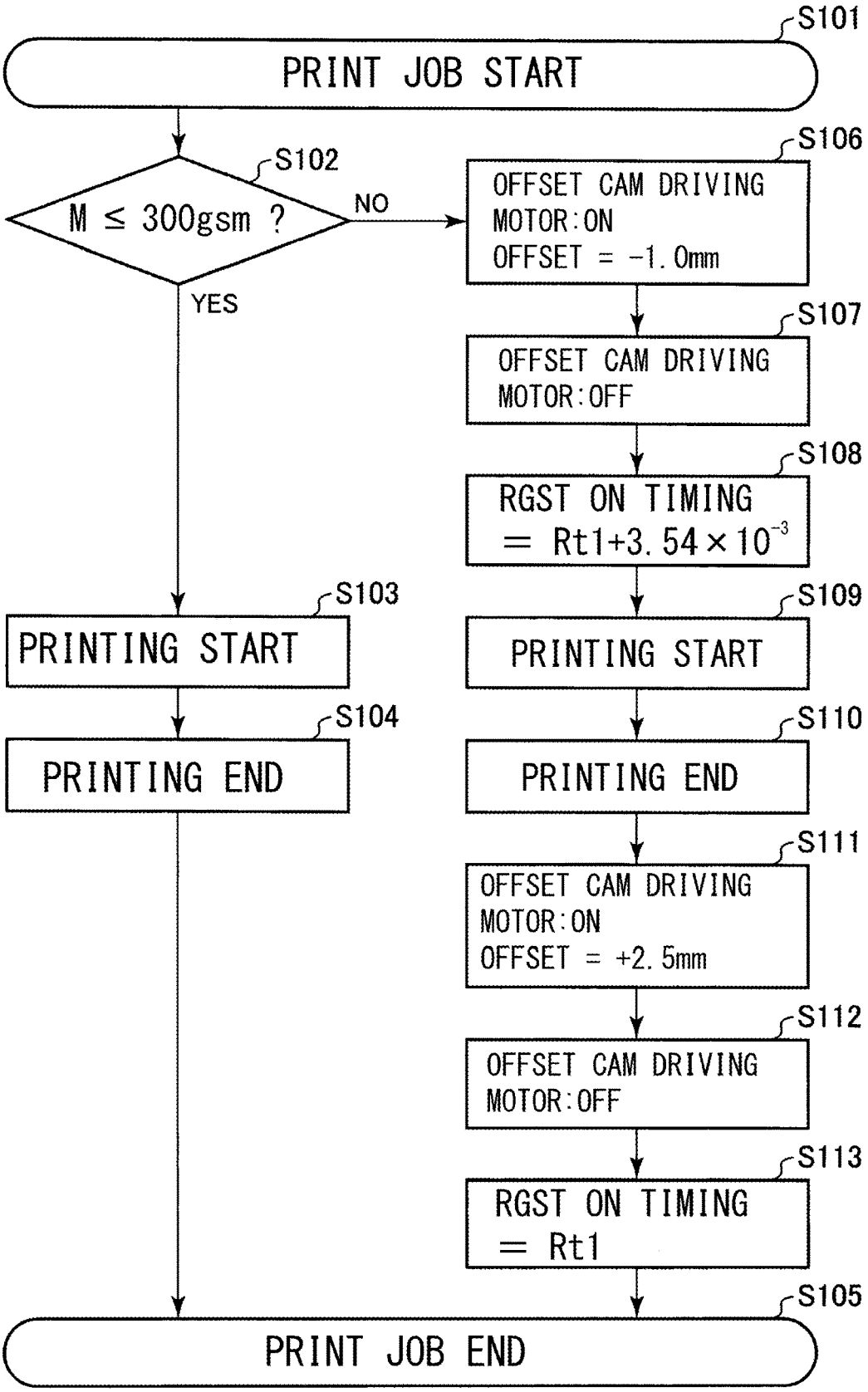

FIG. 7 is a flowchart of control in an embodiment 1.

Figure 8:
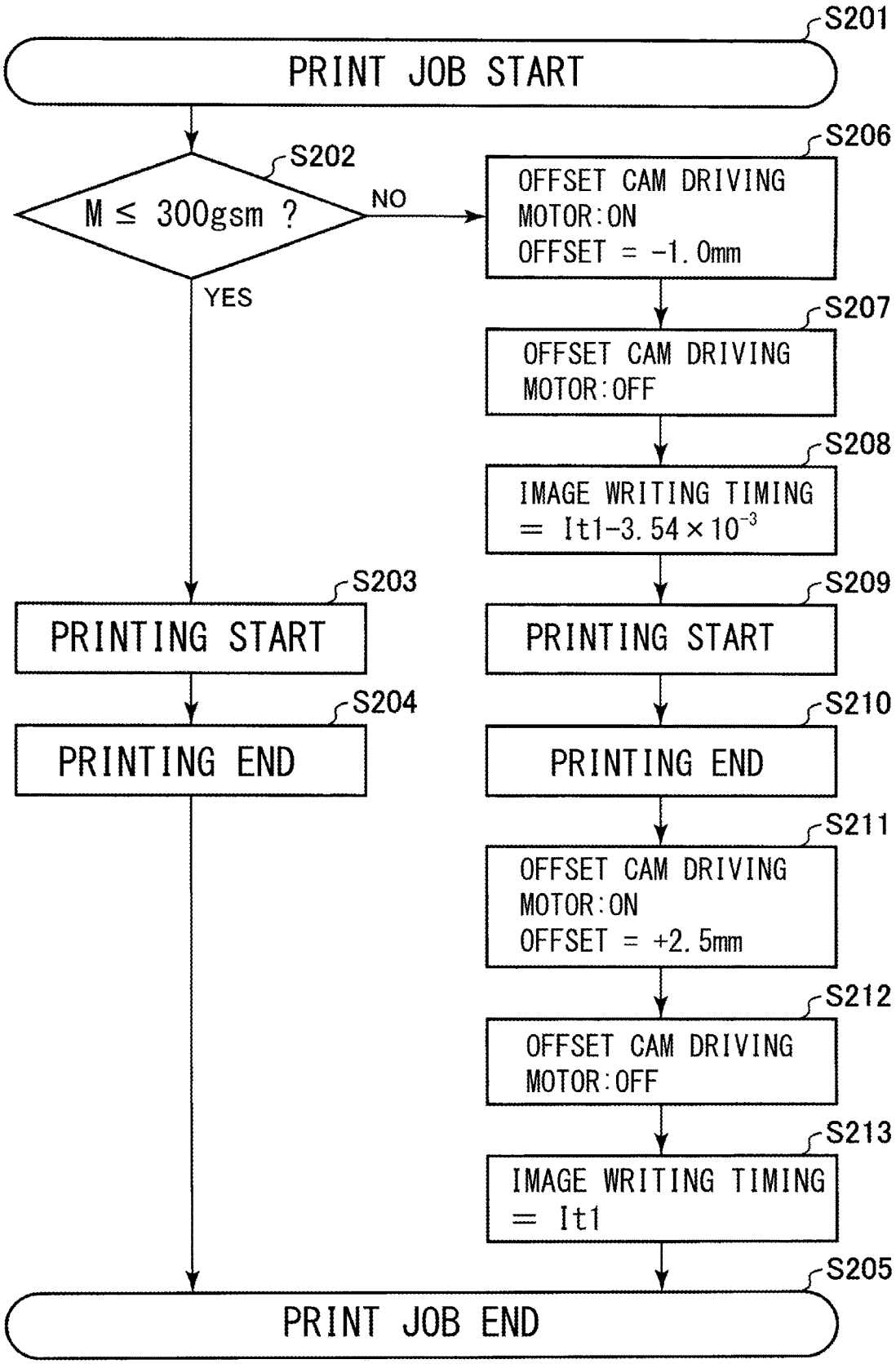

FIG. 8 is a flowchart of control in an embodiment 2.

DESCRIPTION OF THE EMBODIMENTS

In the following, an image forming apparatus according to the present invention will be described with reference to the drawings.

Embodiment 1

1. General Constitution and Operation of Image Forming Apparatus

Figure 1:
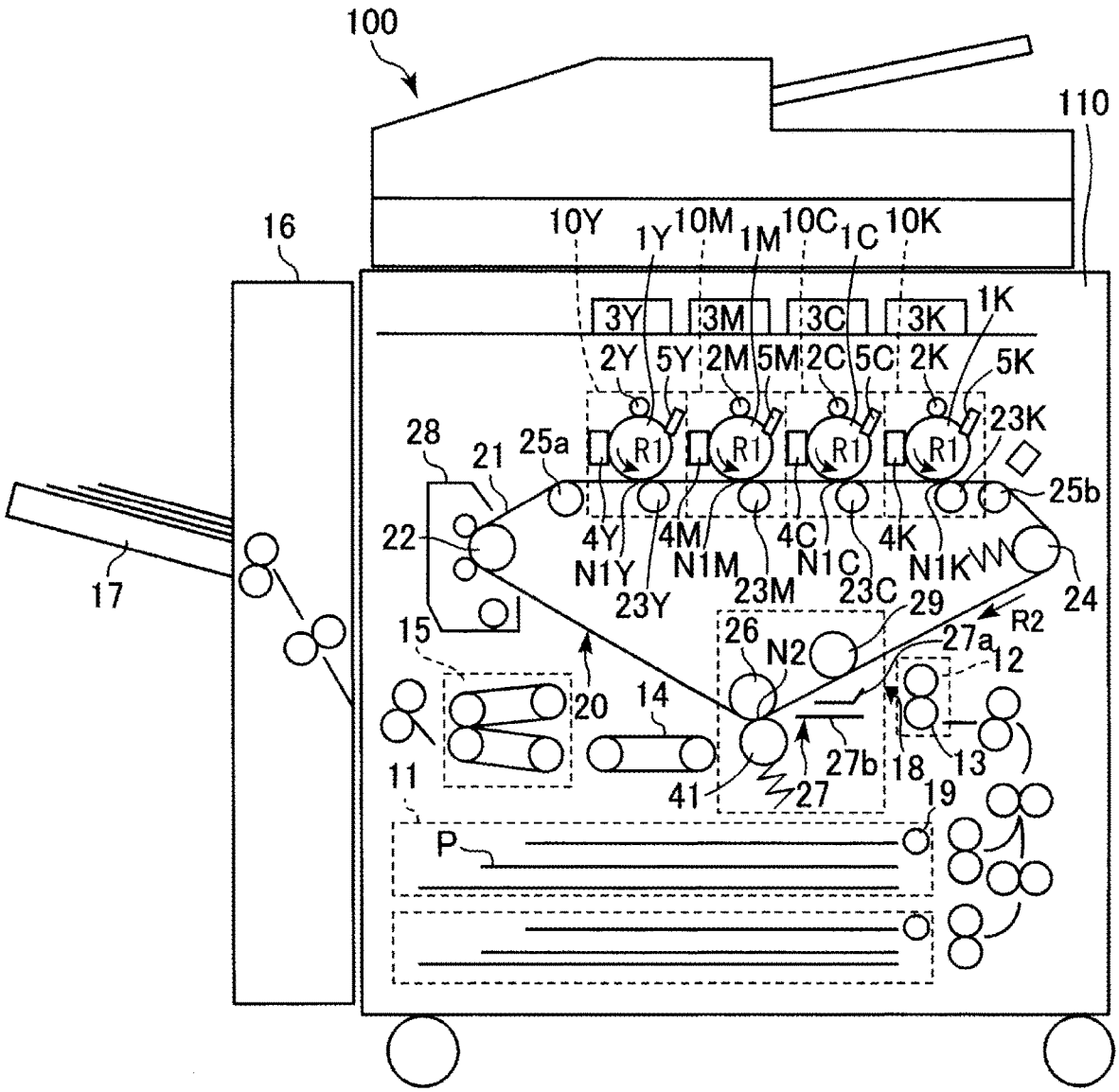
FIG. 1 is a schematic sectional view of an image forming apparatus.

FIG. 1 is a schematic sectional view of an image forming apparatus 100 of the present invention. The image forming apparatus 100 in this embodiment is a tandem multi-function machine (having functions of a copying machine, a printer and a facsimile machines) employing an intermediary transfer type. For example, in accordance with an image signal sent from an external device, the image forming apparatus 100 is capable of forming a full-color image on a sheet-like recording material (a transfer material, a sheet material, a recording medium, media) P such as paper by using an electrophotographic type.

The image forming apparatus 100 includes, as a plurality of image forming means, four image forming portions (stations) 10Y, 10M, 10C and 10K for forming images of yellow (Y), magenta (M), cyan (C) and black (K). These image forming portions 10Y, 10M, 10C and 10K are disposed in line along a movement direction of an image transfer surface disposed substantially parallel to an intermediary transfer belt 21. As regards elements of the image forming portions 10Y, 10M, 10C and 10K having the same or corresponding functions or constitutions, suffixes Y, M, C and K for representing the elements for associated colors are omitted, and the elements will be collectively described in some instances. In this embodiment, the image forming portion 10 is constituted by including a photosensitive drum 1 (1Y, 1K, 1C, 1K), a charging device 2 (2Y, 2M, 2C, 2K), an exposure device 3 (3Y, 3M, 3C, 3K), a developing device 4 (4Y, 4M, 4C, 4K), a primary transfer roller 23 (23Y, 23M, 23C, 23K), a cleaning device 5 (5Y, 5M, 5C, 5K) and the like, which are described later.

The image forming portion 10 is provided with the photosensitive drum 1 which is a rotatable drum-shaped (cylindrical) photosensitive member (electrophotographic photosensitive member) as a first image bearing member for bearing a toner image. To the photosensitive drum 1, a driving force is transmitted from a drum driving portion 111 (FIG. 2) as a driving means including a driving motor 111*a* as a driving source, so that the photosensitive drum 1 is rotationally driven in an arrow R1 direction (counterclockwise direction) in FIG. 1.

A surface of the rotating photosensitive drum 1 is electrically charged uniformly to a predetermined polarity (negative in this embodiment) and a predetermined potential by the charging device (charging roller) 2 as a charging means. During a charging process, to the charging device 2, a predetermined charging voltage is applied from a charging voltage source (not shown). The charged surface of the photosensitive drum 1 is subjected to scanning exposure to light depending on an image signal by the exposure device 3 as an exposure means (electrostatic image forming means), so that an electrostatic image (electrostatic latent image) is formed on the photosensitive drum 1. In this embodiment, the exposure device 3 is constituted by a laser scanner device for irradiating the surface of the photosensitive drum 1 with laser light modulated depending on an image signal. The electrostatic image formed on the photosensitive drum 1 is developed (visualized) by supplying toner as a developer by the developing device 4 as a developing means, so that a toner image (developer image) is formed on the photosensitive drum 1. In this embodiment, the toner charged to the same polarity (negative polarity in this embodiment) as a charge polarity of the photosensitive drum 1 is deposited on an exposed portion (image portion) of the photosensitive drum 1 where an absolute value of the potential is lowered by exposing to light the surface of the photosensitive drum 1 after the photosensitive drum 1 is uniformly charged (reverse development). The developing device 4 includes a developing roller (not shown), which is a rotatable developer carrying member, for feeding the developer to a developing position which is an opposing portion to the photosensitive drum 1 while carrying the developer. The developing roller is rotationally driven by transmitting thereto a driving force from a driving system for the photosensitive drum 1, for example. Further, during development, to the developing roller, a predetermined developing voltage is applied from a developing voltage source (not shown).

As a second image bearing member for bearing the toner image, the intermediary transfer belt 21 which is a rotatable intermediary transfer member constituted by an endless belt is provided so as to oppose the four photosensitive drums 1Y, 1M, 1C and 1K. The intermediary transfer belt 21 is extended around and stretched by a plurality of stretching (supporting) rollers including a driving roller 22, an upstream auxiliary roller 25*a*, a downstream auxiliary roller 25*b*, a tension roller 24, a pre-secondary transfer roller 29 and an inner roller 26. The driving roller 22 transmits a driving force to the intermediary transfer belt 21. The tension roller 24 is provided downstream of a primary transfer nip N1 (described later) and upstream of a secondary transfer nip N2 (described later) with respect to a rotational direction (feeding direction, movement direction, travelling direction) of the intermediary transfer belt 21 and imparts predetermined tension to the intermediary transfer belt 21. The pre-secondary transfer roller 29 forms a surface of the intermediary transfer belt 21 in the neighborhood of the secondary transfer nip N2 on a side unit of the secondary transfer nip N2 with respect to the rotational direction of the intermediary transfer belt 21. The inner roller (inner secondary transfer roller, secondary transfer opposite roller, inner member) 26 functions as an opposing member (opposite electrode) of an outer roller 41 (described later). The upstream auxiliary roller 25*a* and the downstream auxiliary roller 25*b* form the image transfer surface disposed substantially horizontally. The driving roller 22 is rotationally driven by transmission of the driving force thereto from an intermediary transfer belt driving portion 113 (FIG. 2) as a driving means including a belt driving motor 113*a* as a driving source. By this, the driving force is inputted from the driving roller 22 to the intermediary transfer belt 21, so that the intermediary transfer belt 21 is rotated (circulated and moved) in an arrow R2 direction in FIG. 1. Of the plurality of stretching rollers, the stretching rollers other than the driving roller 22 are rotated by rotation of the intermediary transfer belt 21.

On the inner peripheral surface side of the intermediary transfer belt 21, the primary transfer rollers 23Y, 23M, 23C and 23K which are roller-like primary transfer members as primary transfer means are disposed correspondingly to the respective photosensitive drums 1Y, 1M, 1C and 1K. The primary transfer roller 23 is urged toward an associated photosensitive drum 1 through the intermediary transfer belt 21, whereby a primary transfer nip N1 which is a contact portion between the photosensitive drum 1 and the intermediary transfer belt 21 is formed.

The toner image formed on the photosensitive drum 1 as described above is primary-transferred onto the rotating intermediary transfer belt 21 at the primary nip N1 by the action of the primary transfer roller 23. During the primary transfer, to the primary transfer roller 23, a primary transfer voltage which is a DC voltage of an opposite polarity (positive polarity in this embodiment) to a normal charge polarity (the charge polarity of the toner during the development) of the toner is applied by an unshown primary transfer voltage source. For example, during full-color image formation, the color toner images of yellow, magenta, cyan and black formed on the respective photosensitive drums 1 are successively primary-transferred superposedly onto the same image forming region of the intermediary transfer belt 21. In this embodiment, the primary transfer nip N1 is an image forming position where the toner image is formed on the intermediary transfer belt 21. The intermediary transfer belt 21 is an example of an endless belt rotatable while feeding the toner image carried in the image forming position.

On an outer peripheral surface side of the intermediary transfer belt 21, at a position opposing the inner roller 26, an outer roller (outer secondary transfer roller, secondary transfer roller, outer member) 41 which is a roller-like secondary transfer member (rotatable transfer member) as a secondary transfer means is provided. The outer roller 41 is urged toward the inner roller 26 through the intermediary transfer belt 21 and forms the secondary transfer nip N2 as a secondary transfer portion which is a contact portion between the intermediary transfer belt 21 and the outer roller 41. The toner images formed on the intermediary transfer belt 21 as described above are secondary-transferred onto a recording material P sandwiched and fed by the intermediary transfer belt 21 and the outer roller 41 at the secondary transfer portion N2 by the action of the outer roller 41. In this embodiment, during the secondary transfer, to the outer roller 41, a secondary transfer voltage which is a DC voltage of the opposite polarity (positive polarity in this embodiment) to the normal charge polarity of the toner is applied by a secondary transfer voltage source (not shown). In this embodiment, the inner roller 26 is electrically grounded (connected to the ground). Incidentally, the inner roller 26 is used as a secondary transfer member and a secondary transfer voltage of the same polarity as the normal charge polarity of the toner is applied thereto, and the outer roller 41 is used as an opposite electrode and may also be electrically grounded.

The recording material P is fed to the secondary transfer nip N2 by being timed to the toner image on the intermediary transfer belt 21. That is, the recording material P is accommodated in a recording material accommodating portion (cassette) 11. This recording material P is sent from the recording material accommodating portion 11 by a feeding portion such as a feeding roller 19 provided in the recording material accommodating portion 11. The recording material P is fed toward the secondary transfer nip N2 by a registration adjusting portion 12 at predetermined timing (registration ON timing described later) after being adjusted in attitude by the registration adjusting portion 12. Here, the registration adjusting portion 12 includes a pair of registration rollers (registration roller pair) 13 which is a roller-shaped feeding member as a feeding means and a registration roller driving portion (feeding driving portion) 114 (FIG. 2) as a driving means for driving the registration rollers 13. The registration rollers 13 are rotationally driven by the registration roller driving portion 114, so that the recording material P is fed in a contact portion (nip) of the pair of registration rollers 13. Incidentally, the registration roller driving portion 114 includes a registration roller driving motor 114*a* (FIG. 2), and the registration roller driving portion 114 drives at least one (or may also be both) of the pair of registration rollers 13. In this embodiment, a controller (FIG. 2) functions as a registration ON timing changing means and is capable of changing the registration ON timing, i.e., a feeding start timing of the recording material P by the registration rollers 13. Further, the controller 150 controls the number of rotations (turns) (i.e., a rotational speed) of the registration roller driving motor 114*a* of the registration roller driving portion 114 and thus controls the number of rotations (rotational speed) of the registration rollers 130, so that the controller 150 may be capable of changing a feeding speed of the recording material P in the secondary transfer nip N2. The recording material P fed from the recording material accommodating portion 11 is once stopped by the registration rollers 13. Then, this recording material P is sent into the secondary transfer nip N2 by starting (resuming) rotational drive of the registration rollers 13 so that the toner image on the intermediary transfer belt 21 coincides with a desired image forming region on the recording material P in the secondary transfer nip N2. Incidentally, with respect to the feeding direction of the recording material P, in the neighborhood of the registration rollers 13 on a downstream side, a registration sensor 18 as a recording material detecting means (recording material detecting portion) for detecting the recording material P, particularly a leading end of the recording material P is provided.

With respect to the feeding direction of the recording material P, a feeding guide 27 for guiding the recording material P to the secondary transfer nip N2 is provided downstream of the registration rollers 13 and upstream of the secondary transfer nip N2. The feeding guide 27 is constituted by including a first guiding member 27*a* contactable to a front surface of the recording material P (i.e., a surface onto which the toner image is to be transferred immediately after the recording material P passes through the feeding guide 27 and a second guiding member 27*b* contactable to a back surface of the recording material P (i.e., a surface opposite from the front surface). The image guiding member 27*a* and the second guiding member 27*b* are disposed opposed to each other, and the recording material P passes through between these members. The first guiding member 27*a* restricts movement of the recording material P in a direction toward the intermediary transfer belt 21. The second guiding member 27*b* restricts movement of the recording material P in a direction away from the intermediary transfer belt 21.

The recording material P on which the toner images are transferred is fed by a feeding belt 14 toward a fixing device 15 as a fixing means. The feeding belt 14 is driven by a feeding (belt) driving motor (not shown). On the inner peripheral surface side of the feeding belt 14, a suction fan (not shown) for attracting the recording material P is provided and attracts the recording material P toward the feeding belt 14. The fixing device 15 heats and presses the recording material P carrying thereon unfixed toner images, and thus fixes (melts) the toner images on the surface of the recording material P. Thereafter, the recording material P on which the toner images are fixed is discharged (outputted) to a discharge tray 17 provided on an outside of an apparatus main assembly 110 of the image forming apparatus 100 by a discharging device 16.

On the other hand, toner (primary transfer residual toner) remaining on the photosensitive drum 1 after the primary transfer is removed and collected from the surface of the photosensitive drum 1 by a cleaning device 5 as a cleaning means. Further, deposited matters such as toner (secondary transfer residual toner) remaining on the intermediary transfer belt 21 after the secondary transfer, and paper powder guided from the recording material P are removed and collected from the surface of the intermediary transfer belt 21 by a belt cleaning device 28 as an intermediary member cleaning means.

Incidentally, in this embodiment, an intermediary transfer belt unit 20 as a belt feeding device is constituted by including the intermediary transfer belt 21 stretched by the plurality of stretching rollers, the respective primary transfer rollers 23, the belt cleaning device 28, a frame supporting these members, and the like. The intermediary transfer belt unit 20 is mountable to and dismountable from the apparatus main assembly 110 for maintenance and exchange.

2. Offset

Figure 3:
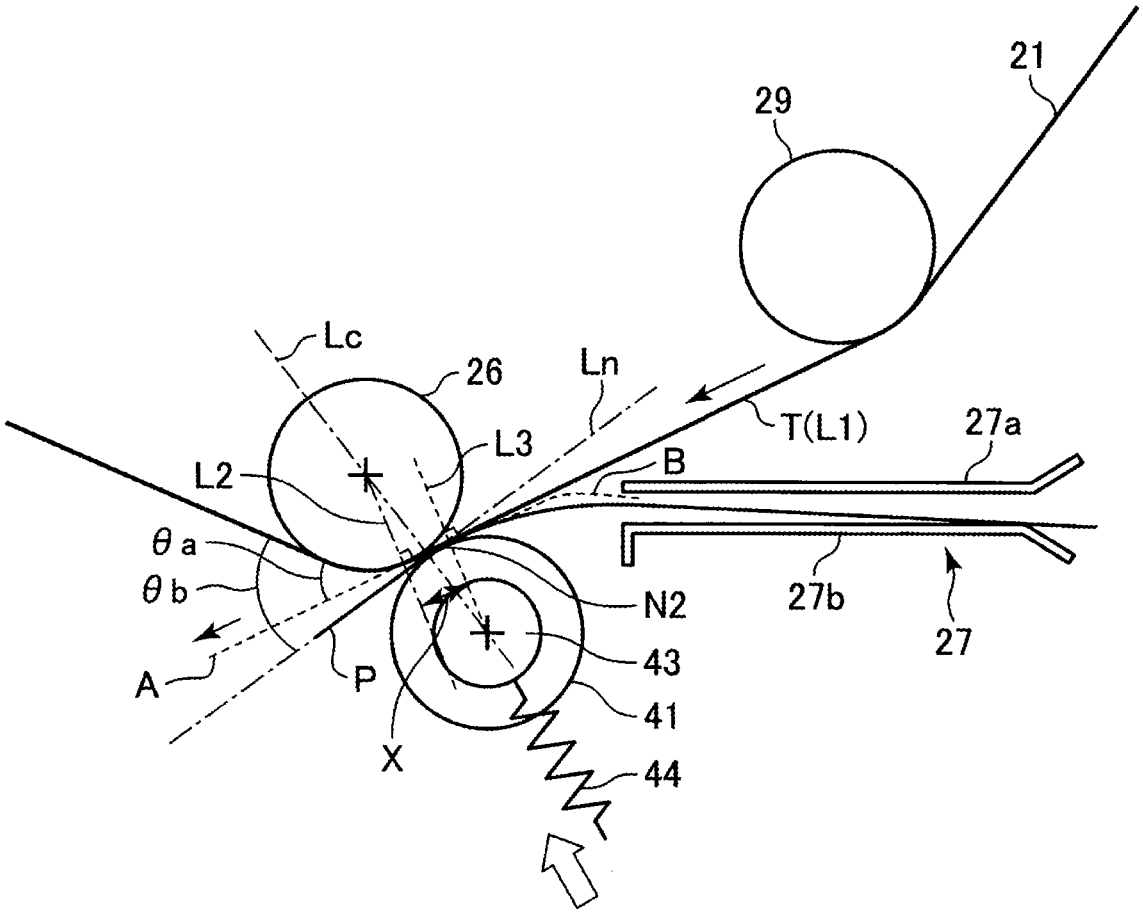
FIG. 3 is a schematic sectional view of a neighborhood of a secondary transfer nip, for illustrating a feeding attitude of a recording material.

FIG. 3 is a schematic sectional view (of a cross section substantially perpendicular to the rotational axis direction of the inner roller 26) for illustrating behavior of the recording material P in the neighborhood of the secondary transfer nip N2. Incidentally, in FIG. 3, elements having identical and corresponding functions and constitutions to those of the image forming apparatus 100 of this embodiment are represented by the same reference numerals or symbols.

Further, in this embodiment, the outer roller 41 is rotatably supported by bearings 43 at opposite end portions thereof with respect to a rotational axis direction. The bearings 43 are slidable (movable) in a direction toward and away from the inner roller 26. The bearing 43 are supported by a frame or the like of the apparatus main assembly 110. The bearings 43 are pressed toward the inner roller 26 by urging spring 44 constituted by compression springs which are urging members (elastic members) as urging means. By this, the outer roller 41 contacts the intermediary transfer belt 21 toward the inner roller 26 at predetermined pressure and forms the secondary transfer nip N2. Further, in this embodiment, the outer roller 41 is rotated by the rotation of the intermediary transfer belt 21. Here, rotational axis directions of the stretching rollers including the inner roller 26 for the intermediary transfer belt 21 and the outer roller 41 are substantially parallel to each other.

As described above, depending on the rigidity of the shape (position) of the secondary transfer nip n2 and the rigidity of the recording material P, the behavior of the recording material P in the neighborhood of the secondary transfer nip N2 on sides upstream and downstream of the secondary transfer nip N2 with respect to the feeding direction of the recording material P changes. For example, in the case where the recording material P is "thin paper" which is an example of paper small in rigidity, a jam (paper jam) occurs in some instances due to improper separation of the recording material P from the intermediary transfer belt 21. This phenomenon becomes conspicuous in the case where the rigidity of the recording material P is small since the recording material P is liable to stick to the intermediary transfer belt 21 due to weak resilience of the recording material P.

That is, in the cross section shown in FIG. 3, a line showing a stretching surface of the intermediary transfer belt 21 stretched and formed by the inner roller 26 and the pre-secondary transfer roller 29 is a pre-nip stretching line T. The pre-secondary transfer roller 29 in an example of the upstream rollers, of the plurality of stretching rollers, disposed adjacent to the inner roller 26 on a side upstream of the inner roller 26 with respect to the rotational direction of the intermediary transfer belt 21. Further, in the same cross section, a rectilinear line passing through a rotation center of the inner roller 26 and a rotation center of the outer roller 41 is a nip center line Lc. In the same cross section, a rectilinear line substantially perpendicular to the nip center line Le is a nip line Ln. Incidentally, FIG. 3 shows a state in which with respect to a direction along the pre-nip stretching line T, the rotation center of the outer roller 41 is offset and disposed on a side upstream of the rotation center of the inner roller 26 with respect to the rotational direction of the intermediary transfer belt 21.

At this time, there is a tendency that the recording material P is liable to maintain an attitude substantially along the nip line Ln in a state in which the recording material P is nipped between the inner roller 26 and the outer roller 41. For that reason, in general, in the case where the rotation center of the inner roller 26 and the rotation center of the outer roller 41 are close to each other with respect to the direction along the pre-nip stretching line T, as shown by a broken line A in FIG. 3, a discharge angle θa of the recording material P becomes small. That is, a leading end of the recording material P adopts an attitude such that the recording material P is discharged near to the intermediary transfer belt 21 when the recording material P is discharged near to the intermediary transfer belt 21 when the recording material P is discharged from the secondary transfer nip N2. By this, the recording material P is liable to stick to the intermediary transfer belt 21. On the other hand, in the case where the rotation center of the outer roller 41 is disposed on a side more upstream of the rotation center of the inner roller 26 with respect to the pre-nip rotation centering line T, as shown by a solid line in FIG. 3, the discharge angle θb of the recording material P becomes large. That is, the leading end of the recording material P adopts an attitude such that the recording material P is discharged in a direction away from the intermediary transfer belt 21 when the recording material P is discharged from the secondary transfer nip N2. By this, the recording material P does not readily stick to the intermediary transfer belt 21.

On the other hand, for example, in the case where the recording material P is "thick paper" which is an example of a recording material P large in rigidity, when a trailing end of the recording material P with respect to the feeding direction of the recording material P passes through the feeding guide 27, a trailing end portion of the recording material P collides with the intermediary transfer belt 21 in some instances. By this, an image defect occurs at the trailing end portion of the recording material P in some instances. This phenomenon becomes conspicuous in the case where the rigidity of the recording material P is large since due to storing resilience of the recording material P, the trailing end portion of the recording material P with respect to the feeding direction is liable to vigorously collide with the intermediary transfer belt 21.

That is, as described above, in the cross section shown in FIG. 3, in a state in which the recording material P is nipped between the inner roller 26 and the outer roller 41 in the secondary transfer nip N2, there is a tendency that the recording material P is liable to maintain the attitude thereof substantially along the nip line Ln. For that reason, in general, the nip line Ln approaches and contacts the pre-nip stretching line T as with respect to the direction along the pre-nip stretching line T, the rotation center of the outer roller 41 is disposed on a side more upstream than the rotation center of the inner roller 26 in the rotational direction of the recording material P. As a result, when the trailing end of the recording material P with respect to the feeding direction passed through the feeding guide 27, as shown by a broken line B in FIG. 3, the trailing end portion of the recording material P collides with the intermediary transfer belt 21, so that the image defect is liable to occur at the trailing end portion of the recording material P. On the other hand, when the rotation center of the inner roller 26 and the rotation center of the outer roller 41 are brought near to each other with respect to the direction along the pre-nip stretching line T, collision of the recording material P with the intermediary transfer belt 21 when the trailing end of the recording material P passed through the feeding guide 27 is suppressed. By this, the image defect at the trailing end portion of the recording material P does not readily occur.

Accordingly, in order to realize improvement in separating property of the recording material P from the intermediary transfer belt 21 and suppression of the image defect at the trailing end portion of the recording material P with respect to the feeding direction, the following is effective. Depending on the kind of the recording material P, a relative position between the inner roller 26 and the outer roller 41 with respect to a circumferential direction of the inner roller 26 (the rotational direction of the intermediary transfer belt 21) is changed, so that the shape (position) of the secondary transfer nip N2 is changed.

With reference to FIG. 3, definition of an offset amount X indicating the relative position between the inner roller 26 and the outer roller 41 will be described. In the cross section shown in FIG. 3, a common tangential line of the inner roller 26 and the pre-secondary transfer roller 29 on a side where the intermediary transfer belt 21 is extended around the stretching rollers is a reference line L1. The reference line L1 corresponds to the pre-nip stretching line T. Further, in the same cross section, a rectilinear line which passes through the rotation center of the inner roller 26 and which is substantially perpendicular to the reference line L1 is referred to as an inner roller center line L2. Further, in the same cross section, a rectilinear line which passes through the rotation center of the outer roller 41 and which is substantially perpendicular to the reference line L1 is referred to as an outer roller center line L3. At this time, a distance (vertical distance) between the inner roller center line L2 and the outer roller center line L3 is the offset amount X (in this case, the offset amount X is a positive value when L3 is on the side upstream of L2 with respect to the rotational direction of the intermediary transfer belt 21). The offset amount X can be a negative value, zero and the positive value. By making the offset amount X large, a width of the secondary transfer nip N2 with respect to the rotational direction of the intermediary transfer belt 21 extends toward an upstream side of the rotational direction of the intermediary transfer belt 21. That is, with respect to the rotational direction of the intermediary transfer belt 21, an upstream end portion of a contact region between the outer roller 41 and the intermediary transfer belt 21 is positioned on an upstream side than an upstream end portion of a contact region between the inner roller 26 and the intermediary transfer belt 21 is. Thus, by changing a position of at least one of the inner roller 26 and the outer roller 41, the relative position between the inner roller 26 and the outer roller 41 with respect to the circumferential direction of the inner roller 26 is changed, so that the position of the secondary transfer nip (transfer portion) N2 is changeable.

Here, in FIG. 3, the outer roller 41 is illustrated so as to virtually contact the reference line L1 (pre-nip stretching line T) without being deformed. However, a material of an outermost layer of the outer roller 41 is an elastic member such as a rubber or a sponge, so that in actuality, the outer roller 41 is pressed and deformed toward the inner roller 26 by the urging spring 44. When the outer roller 41 is offset and disposed toward the upstream side with respect to the rotational direction of the intermediary transfer belt 21 relative to the inner roller 26 and is pressed by the urging spring 44 so as to nip the intermediary transfer belt 21 between itself and the inner roller 26, the secondary transfer nip N2 in a substantially S shape is formed. Further, the attitude of the recording material P guided and sent to the feeding guide 27 is also determined in conformity to the shape of the secondary transfer nip N2. With an increasing offset amount X, a bending amount of the recording material P increases. For that reason, for example, in the case where the recording material P is the "thin paper", by making the offset amount X large, the separating property of the recording material P, from the intermediary transfer belt 21, passed through the secondary transfer nip N2 can be improved. However, when the offset amount X is large, the bending amount of the recording material P is large, so that in the case where for example, the recording material P is the "thick paper", when the trailing end of the recording material P passed through the feeding guide 27, the collision of the trailing end portion of the recording material P with the intermediary transfer belt 21 is liable to occur. This causes a lowering in image quality of the trailing end portion of the recording material P, but in this case, it may only be required that the offset amount X is made small.

In this embodiment, the image forming apparatus 100 changes the offset amount X by changing the position of at least one of the inner roller 26 or the outer roller 41. Particularly, in this embodiment, the image forming apparatus 100 changes the offset amount X on the basis of information on a basis weight of the recording material (paper) P as information on the kind of the recording material P relating to rigidity of the recording material P. For example, in the case where the recording material P is the "thin paper", the inner roller 26 is disposed in a first inner roller position where the offset amount X is a first offset amount X1. Further, in the case where the recording material P is the "thick paper", the inner roller 26 is disposed in a second inner roller position where the offset amount X is a second offset amount X2 smaller than the first offset amount X1. The first offset amount X1 is typically a positive value, and the second offset amount X2 may be a positive value, zero and a negative value, and the second offset amount X2 is typically a positive value. In this embodiment, the relative position between the inner roller 26 and the outer roller 41 in the case where the offset amount X is the first offset amount X1 is a first relative position, and the relative position between the inner roller 26 and the outer roller 41 in the case where the offset amount X is the second offset amount X1 is a second relative position. That is, the position of the secondary transfer nip N2 in the case where the offset amount X is the first offset amount X1 is a first position of the transfer portion, and the position of the secondary transfer nip N2 in the case where the offset amount X is the second offset amount X2 is a second position of the transfer portion.

3. Offset Mechanism

An offset mechanism 101 in this embodiment will be described. In this embodiment, the "thin paper" is used as an example of the recording material P small in rigidity, and the "thick paper" is used as an example of the recording material P large in rigidity. Parts (a) and (b) of FIG. 3 are schematic side views of a principal part of the neighborhood of the secondary transfer nip N2 in this embodiment as seen substantially in parallel to the rotational axis direction on one end portion side (the front (surface) side in FIG. 1) with respect to the rotational axis direction of the inner roller 26. Part (a) of FIG. 4 shows a state of the case where a condition of the recording material P passing through the secondary transfer nip N2 is the "thin paper", and part (b) of FIG. 4 shows a state of the case where the condition is the "thick paper".

As shown in parts (a) and (b) of FIG. 4, in the case where the image forming apparatus 100 includes an offset amount changing mechanism as a offset amount changing means (hereinafter, simply referred to as an "offset mechanism") 101. In this embodiment, the offset mechanism 101 functions as a position changing means (position changing mechanism) and changes an offset amount X by changing a relative position of the inner roller 26 (relative) to the outer roller 41. In parts (a) and (b) of FIG. 4, a structure of the inner roller 26 at one end portion of the inner roller 26 with respect to the rotational axis direction is shown, but a structure of the inner roller 26 at the other end portion is also the same (i.e., these (opposite) end portions are substantially symmetrical to each other on the basis of a center of the inner roller 26 with respect to the rotational axis direction).

The opposite end portions of the inner roller 26 with respect to the rotational axis direction are rotatably supported by an inner roller holder 38 as a supporting member. The inner roller holder 38 is supported by a frame or the like of the intermediary transfer belt unit 20 so as to be rotatable about an inner roller rotation shaft 38*a*. Thus, the inner roller holder 38 is rotated about the inner roller rotation shaft 38*a*, so that the inner roller 26 is rotated about the inner roller rotation shaft 38*a*, so that the relative position of the inner roller 26 to the outer roller 41 is changed and thus the offset amount X can be changed.

The inner roller holder 38 is constituted so as to be rotated by the action of an offset cam 39 as an acting member. The offset cam 39 is supported by the frame or the like of the intermediary transfer belt unit 20 so as to be rotatable about the offset cam rotation shaft 39*a*. The offset cam 39 is rotatable about the offset cam rotation shaft 39*a* by receiving the driving force (drive) from an offset cam driving motor 101*a* as a driving source. Further, the offset cam 39 contacts an offset cam follower (arm portion) 38*c* provided as a part of the inner roller holder 38. Further, as described later, the inner roller holder 38 is urged by tension of the intermediary transfer belt 21 so that the offset cam follower 38*c* rotates in a direction in which the offset cam follower 38*c* contacts the offset cam 39. However, the present invention is not limited thereto, but the inner roller holder 38 may also be urged by a spring or the like which is an urging member (elastic member) as an urging means, so that the offset can follower 38*c* rotates in a direction in which the offset cam follower 38*c* contacts the offset cam 39.

Further, in this embodiment, the image forming apparatus 100 is provided with an offset cam position sensor 37, for detecting the position of the offset cam 39 with respect to the rotational direction, as a detecting means for detecting the relative position between the inner roller 26 and the outer roller 41 (i.e., the position of the inner roller 26 in this embodiment). The offset cam position sensor 37 can be constituted by, for example, a flag provided on or coaxially with the offset cam 39 and a photo-interrupter or the like as a detecting portion.

As described above, in this embodiment, the offset mechanism 101 is constituted by including the inner roller holder 38, the offset cam 39, the offset cam driving motor 101*a*, the offset cam position sensor 37 and the like.

As shown in part (a) of FIG. 4, in the case of the "thin paper", the offset cam 39 is rotated, for example, counterclockwise by being driven by the offset cam driving motor 101*a*. By this, the inner roller holder 38 is rotated clockwise about the inner roller rotation shaft 38*a*, so that the relative position of the inner roller 26 to the outer roller 41 is determined. By this, the inner roller 26 is disposed in a state in which the inner roller 26 is in the second inner roller position where the offset amount X is the first offset amount X1 which is relatively large. In this state, the recording material P is liable to bend in the secondary transfer nip N2, and therefore, as described above, the separating property of the "thin paper" from the intermediary transfer belt 21 after passed through the secondary transfer nip N2 is improves.

As shown in part (b) of FIG. 4, in the case of the "thick paper", the offset cam 39 is rotated, for example, clockwise by being driven by the offset cam driving motor 101*a*. By this, the inner roller holder 38 is rotated counterclockwise about the inner roller rotation shaft 38*a*, so that the relative position of the inner roller 26 to the outer roller 41 is determined. By this, the inner roller 26 is disposed in a state in which the inner roller 26 is in the first inner roller position where the offset amount X is the second offset amount X2 which is relatively small. In this state, a degree of bending of the recording material P in the secondary transfer nip N2 can be reduced, and therefore, as described above, it is possible to suppress a lowering in image quality at the trailing end portion of the "thick paper".

In this embodiment, on the basis of a basis weight M (gsm) of the recording material P, the offset amounts X (X1, X2) are set at, for example, the following two patterns. Here, "gsm" means $g/m^2$.

(a) M≤300 gsm: X1=+2.5 mm (b) M>300 gsm: X2=−1.0 mm

In this embodiment, the position (the relative position between the inner roller 26 and the outer roller 41) of the inner roller 26 in the above setting (a) shown in part (a) of FIG. 4 is a home position of the inner roller 26 (the relative position between the inner roller 26 and the outer roller 41). Here, the home position refers to a position when the image forming apparatus 100 is in a sleep state (described later) or when a main switch (main power source) is turned off. However, the present invention is not limited thereto, but the position of the inner roller 26 in the above setting (b) shown in part (b) of FIG. 4 may also similarly be the home position.

Further, the offset amount X and the kind (the basis weight of the recording material P in this embodiment) of the recording material P assigned to the offset amount X are not limited to the above-described specific examples. These values can be appropriately set through an experiment or the like from viewpoints such as the improvement in separating property of the recording material P from the intermediary transfer belt 21 and the suppression of the image defect occurring in the neighborhood of the secondary transfer nip N2. For example, in the constitution of this embodiment, but the offset amount X may suitably be about −3 mm to about +3 mm. The patterns of the offset amount X are not limited to the two patterns, but may also be set at three or more patterns. Further, in conformity with this embodiment, a proper setting can be selected from the settings of the three or more patterns on the basis of the information or the like on the basis weight of the recording material P as the information on the kind of the recording material P relating to the rigidity of the recording material P.

In this embodiment, in the cross sections shown in parts (a) and (b) of FIG. 4, to the inner roller holder 38, counterclockwise moment about the inner roller rotation shaft 38*a* is always exerted by the tension of the intermediary transfer belt 21. That is, in this embodiment, by the tension of the intermediary transfer belt 21, moment in a direction in which the offset cam follower 38*c* rotates so as to engage with the offset cam 39 is always exerted on the inner roller holder 38. Further, in the cross-section shown in parts (a) and (b) of FIG. 4, the inner roller rotation shaft 38*a* is disposed on a side downstream, with respect to the feeding direction of the recording material P, of the rectilinear line (nip center line) Lc connecting the rotation center of the inner roller 26 and the rotation center of the outer roller 41. By this, in the case where the outer roller 41 is contacted to the intermediary transfer belt 21 toward the inner roller 26, reaction force received by the inner roller holder 38 from the outer roller 41 also constitutes the counterclockwise moment in parts (a) and (b) of FIG. 4. By such a constitution, the cam mechanism can be constituted without separately using an urging member such as a spring.

Further, in order to exchange the intermediary transfer belt 21, the inner roller holder 38 may desirably be disposed inside the stretching surface of the intermediary transfer belt 21 so as not to impair operativity of an operation in which the intermediary transfer belt 21 is mounted in or dismounted from the intermediary transfer belt unit 20. For that reason, in the cross section shown in parts (a) and (b) of FIG. 4, the inner roller rotation shaft 38*a* may desirably be disposed in a region A between the above-described rectilinear line (nip center line) Lc and a post-nip stretching line U. Here, the post-nip stretching line U is a line indicating the stretching surface of the intermediary transfer belt 21 stretched and formed by the inner roller 26 and the driving roller 22 (FIG. 1) in the cross section shown in parts (a) and (b) of FIG. 4. Incidentally, the driving roller 22 is an example of the downstream rollers, of the plurality of stretching rollers, disposed downstream of and adjacent to the inner roller 26 with respect to the rotational direction of the intermediary transfer belt 21.

FIG. 5 is a schematic side view of the inner roller holder 38 and the neighborhood thereof as seen in substantially parallel to the rotational axis direction of the inner roller 26 on the one end portion side (the front side on the drawing sheet of FIG. 1) with respect to the rotational axis direction. A state shown by a chain double-dashed line in FIG. 5 is a state in which the inner roller 26 is in a position of the case of the "thick paper". In this state, by the tension of the intermediary transfer belt 21 and the reaction force received from the outer roller 41, the inner roller holder 38 receives the counterclockwise moment about the inner roller rotation shaft 38*a*. Then, a cylindrical abutment portion 38*b* provided as a part of the inner roller holder 38 coaxially with the inner roller 26 abuts against a second positioning portion 40*b*. By this, the inner roller 26 is positioned in a position of the second offset amount X2 (=−1.0 mm). A state shown by a solid line in FIG. 5 is a state of the position of the inner roller 26 corresponding to the "thin paper". The offset cam 39 is rotated and contacts and presses the arm portion 38*c* of the inner roller holder 38, so that the inner roller holder 38 is rotated clockwise about the inner roller rotation shaft 38*a*. Then, the abutment portion 38*b* abuts against a first positioning portion 40*a*. By this, the inner roller 26 is positioned in a position of the first offset amount X1 (=+2.5 mm). Incidentally, the first and second positioning portions 40*a* and 40*b* are provided on the frame or the like of the intermediary transfer belt unit 20.

4. Change of Offset Amount X and Leading End Misregistration

Next, the leading end misregistration with the above-described change of the offset amount X will be further described. FIG. 6 is a schematic sectional view (cross section substantially perpendicular to the rotational axis direction of the inner roller 26) of the intermediary transfer belt 21, in which a stretched state of the intermediary transfer belt 21 in the case where the offset amount X is different. A solid line in FIG. 6 shows the stretched state in the case where the inner roller 26 is in the position of the first offset amount X1, and a chain double-dashed line shows the stretched state in the case where the offset amount X is in the position of the second offset amount X2.

In this embodiment, the tension belt 24 receives an urging force from a tension spring 24*a* constituted by a compression spring which is an urging member (elastic member) as an urging means (tension imparting member). Further, in this embodiment, the tension roller 24 is supported so as to be movable in a direction (arrow S direction in FIG. 6) along an urging direction of the tension spring 24*a*. By this, the tension roller 24 presses the intermediary transfer belt 2) from an inner peripheral surface side toward an outer peripheral surface side thereof, and thus imparts predetermined tension to the intermediary transfer belt 21. For that reason, in this embodiment, with respect to the arrow S direction, a position of the tension roller 24 is determined at a position where the urging force of the tension spring 24*a* balances with a reaction force received from the intermediary transfer belt 21.

Incidentally, a constitution movably supporting the tension roller 24 is provided for a frame or the like of the intermediary transfer belt unit 20. In this embodiment, opposite end portions of the tension roller 24 with respect to the rotational axis direction are rotatably supported by bearing members (not shown). Each of the bearing members is held by the frame of the intermediary transfer belt unit 20 so as to be slidable (movable) in the direction (arrow surface direction in FIG. 6) along the urging direction by the tension spring 24*a*. Further, by the tension spring 24*a* mounted in a compressed state between the bearing member and the frame of the intermediary transfer belt unit 20, the tension roller 24 is urged through the bearing members from the inner peripheral surface side toward the outer peripheral surface side of the intermediary transfer belt 21.

In the case where the position of the inner roller 26 is moved with the change of the offset amount X, as shown in FIG. 6, with respect to the rotational direction of the intermediary transfer belt 21, a stretched form of the intermediary transfer belt 21 between the inner roller 26 and each of the stretching rollers provided upstream and downstream of the inner roller 26 and a length of the intermediary transfer belt 21 between the stretching rollers with respect to a circumferential direction change. For example, a length of the intermediary transfer belt 21, with respect to the circumferential direction, between the inner roller 26 and the driving roller 22 which is the stretching roller immediately downstream of the inner roller 26 with respect to the rotational direction of the intermediary transfer belt 21 is Ld. Further, Ld in the case where the inner roller 26 is in the position of the first offset amount X1 (solid line in FIG. 6) is Ld1, and Ld in the case where the inner roller 26 is in the position of the second offset amount X2 (chain double-dashed line in FIG. 6) is Ld2. At this time, in the constitution in this embodiment, Ld1 is larger than Ld2 (Ld1>Ld2). This is because in the constitution in this embodiment, in the case of the first offset amount X1, compared with the case of the second offset amount X2, the inner roller 26 is disposed at a position where the inner roller 26 is moved in a leftward direction (direction toward the outer peripheral surface side of the intermediary transfer belt 21) in FIG. 6 and thus Ld becomes long.

On the other hand, a circumferential leading end of the intermediary transfer belt 21 a certain value, and certain tension is exerted on the intermediary transfer belt 21 by the tension roller 24 as described above. For that reason, in the case where Ld changes, a tension balance position changes, so that the tension roller 24 moves. That is, with a change of the offset amount X, the position of the tension roller 24 changes. In the constitution in this embodiment, in the case of the first offset amount X1 (solid line in FIG. 6), compared with the case of the second offset amount X2 (chain double-dashed line in FIG. 6), the position of the tension roller 24 is determined to a position where the tension roller 24 moves in a leftward direction (direction toward the inner peripheral surface side of the intermediary transfer belt 21) in FIG. 6. This is because correspondingly to a change of Ld under the condition of each of the offset amounts X as described above, a length of the intermediary transfer belt 21, with respect to the circumferential direction, between the inner roller 26 and the roller upstream of the inner roller 26 with respect to the rotational direction of the intermediary transfer belt 21 changes. In the constitution in this embodiment, in the case of the first offset amount X1 (solid line in FIG. 6), compared with the case of the second offset amount X1 (chain double-dashed line in FIG. 6), a length of the intermediary transfer belt 21, with respect to the circumferential direction, between the upstream roller and the inner roller 26 becomes long. A length along the circumferential direction of the intermediary transfer belt 21 from the primary transfer nip N1K for black to the secondary transfer nip N2 is Lt. Further, Lt in the case where the inner roller 26 is in the position of the first offset amount X1 (solid line in FIG. 6) is Lt1, and Lt in the case where the inner roller 26 is in the position of the second offset amount X2 (chain double-dashed line in FIG. 6) is Lt2. At this time, in the constitution in this embodiment, Lt1 is shorter than Lt2.

When the length Lt is different, a time required until the toner image primary-transferred onto the intermediary transfer belt 21 at the primary transfer nip N1K for black is secondary-transferred onto the recording material P is also different. That is, by the change of the offset amount X, as a result, a leading end position (in this embodiment, referred also to as a "leading end registration position" of the toner image, with respect to the feeding direction of the recording material P, formed on the recording material P deviates from a desired (original) position. Incidentally, the leading end registration position is specifically represented by a leading end position of an image forming region (region in which the toner image is capable of being formed) on the recording material P. Thus, a phenomenon (leading end misregistration, registration deviation) that the leading end position of the image formed on the recording material P is deviated from the desired (original) position occurs.

As described above, in the constitution of this embodiment, Lt1<Lt2 holds. For that reason, in the case of the first offset amount X1, the leading end registration position is deviated toward a downstream side with respect to the feeding direction of the recording material P than in the case of the second offset amount X2. That is, a deviation amount of the leading end registration position depending on the offset amount X (in this embodiment, this deviation amount is also referred to as a "leading end misregistration amount" is ΔR(X) (unit: mm). Further, the leading end misregistration amount in the case of the first offset amount X1 is ΔR(X1), and the leading end misregistration amount of the case of the second offset amount X2 is ΔR(X2). In the constitution in this embodiment, the leading end misregistration amount ΔR(X), acquired on the basis of an experimental data, depending on the offset amount X is:

$$\Delta R(X1)=0, \text{ and}$$

$$\Delta R(X2)=1.54.$$

Here, the reason why $\Delta R(X1)=0$ is that in the constitution of this embodiment, the position of the inner roller 26 in the case of the first offset amount X1 is a home position and on the basis of the leading end registration position in this condition, the leading end misregistration amount $\Delta R(X)$ is defined. Further, as regards the leading end misregistration amount $\Delta R(X)$, deviation toward the upstream side with respect to the feeding direction of the recording material P is taken as a positive direction. Different from the constitution in this embodiment, in the case where the position of the inner roller 26 in the case of the second offset amount X2 is the home position of the inner roller 26, the leading end misregistration amount $\Delta R(X)$ relatively is changed in value from the above-described value, so that $\Delta R(X1)=-1.54$ and $\Delta R(X2)=0$. Further, in this embodiment, for simplification, the leading end misregistration amount was described by taking, as an example, the toner image primary-transferred at the primary transfer nip N1K for black, i.e., the black image. Also, as regards the toner images primary-transferred at the primary transfer nips (N1Y, N1M, N1C) for other colors, the leading end misregistration amounts caused by the change of the offset amount X are the same, and therefore, will be omitted from redundant description.

As described above, the leading end registration position is different by the offset amount X. This is because depending on the offset amount X, the length of the intermediary transfer belt 21, with respect to the circumferential direction, from the primary transfer nip N1 to the secondary transfer nip N2 is different and thus the leading end registration position of the image secondary-transferred onto the recording material P deviates.

Therefore, the image forming apparatus 100 of this embodiment changes feeding start timing of the recording material P toward the secondary transfer nip N2 by the registration rollers 13 (in this embodiment, this timing is also referred to as a "registration ON timing". By this, the image forming apparatus 100 of this embodiment suppresses the leading end misregistration in the secondary transfer nip N2 due to the change of the offset amount X. Incidentally, in this embodiment, a feeding speed (represented by a peripheral speed of the registration rollers 13) of the recording material P by the registration rollers 13 is constant irrespective of the offset amount X.

In the constitution in this embodiment, compared with the case of the first offset amount X1, in the case of the second offset amount X2, the leading end registration position on the recording material position shifts toward the upstream side with respect to the feeding direction of the recording material P by $\Delta R(X1)-\Delta R(X1)$. Here, the registration ON timing depending on the offset amount X is Rt(X) (unit: s). Further, the registration ON timing of the first offset amount X1 is Rt(X1), and the registration on timing of the second offset amount X2 is Rt(X2). Further, a feeding speed of the intermediary transfer belt 21 is VI (unit: mm/s). In this embodiment, the feeding speed (represented by the peripheral speed of the driving roller 22) of the intermediary transfer belt 21 corresponds to a process speed of the image forming apparatus 100. At this time, in this embodiment, in the case where the offset amount X is switched from the first offset amount X1 to the second offset amount X2, the registration ON timing is latened by $((Rt(X2)-Rt(X1))=(\Delta R(X2)-\Delta R(X1))/\Delta VI$. By this, the leading end misregistration can be suppressed. That is, timing when the leading end of the image forming region on the intermediary transfer belt 21 reaches the secondary transfer nip N2 and timing when the leading end of the image forming region on the recording material P can be caused to coincide with each other. Incidentally, in this embodiment, VI is 430 (mm/s). For that reason, in this embodiment, in the case where the offset amount X is switched from the first offset amount X1 to the second offset amount X2, the registration ON timing may only be required to be latened by $Rt(X2)-Rt(X1)=(\Delta R(X2)-\Delta R(X1))/VI=3.54\times10^{-3}$ (s).

5. Control Mode

Figure 2:
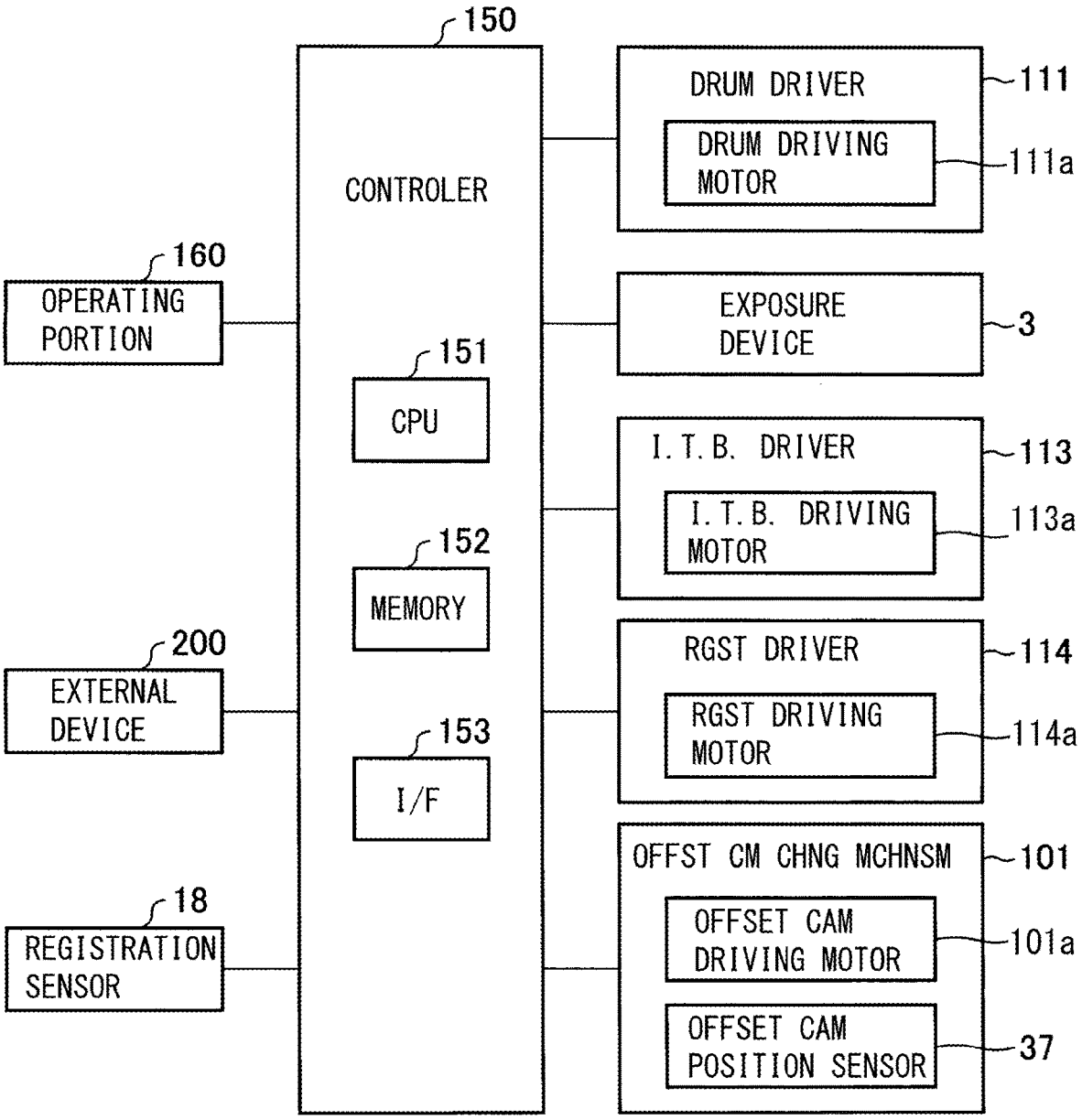
FIG. 2 is a schematic block diagram showing a control mode of a principal part of the image forming apparatus.

FIG. 2 is a schematic block diagram showing a control mode of a principal part of the image forming apparatus 100 in this embodiment. The image forming apparatus 100 includes the controller 150 as a control means. The controller 150 is constituted by including a CPU 151 as a calculation control means which is a dominant element for performing processing, memories (storing media) 152 such as a ROM and a RAM which are used as storing means, and an interface (I/F) portion 153 and the like. In the RAM which is rewritable memory, information inputted to the controller 150, detected information, a calculation result and the like are stored. In the ROM, a data table acquired in advance and the like are stored. The CPU 151 and the memories 152 are capable of transferring and reading the data therebetween. The interface portion 153 controls input and output (communication) of signals between the controller 150 and devices connected to the controller 150.

To the controller 150, respective portions (the image forming portions 10, the intermediary transfer belt 21, driving devices for the members relating to feeding of the recording material P, various voltage sources and the like) of the image forming apparatus 100 are connected. For example, to the controller 150, the drum driving portion 111, the exposure device (laser scanner device) 3, the intermediary transfer belt driving portion 113, the registration roller driving portion 114, the offset mechanism 101, various high-voltage sources (for the charging voltage, the developing voltage, the primary transfer voltage and the secondary transfer voltage) and the like are connected. Further, to the controller 150, signals (output values) indicating detection results of the various sensors such as the offset cam position sensor 37 are inputted. An output value of the offset cam position sensor 37, i.e., the information on the position (relative position between the inner roller 26 and the outer roller 41) of the inner roller 26 is stored in the memory 152. Further, to the controller 150, the operating portion (operating panel) 160 provided on the image forming apparatus 100 is connected. The operating portion 160 includes a display means for displaying information by control of the controller 150 and an input means for inputting information to the controller 150 through an operation by an operator such as a user or a service person. The operating portion 160 may be constituted by including a touch panel having functions of the display means and the input means. Further, to the controller 150, an image reading apparatus (not shown) provided in or connected to the image forming apparatus and an external device 200 such as a personal computer connected to the image forming apparatus 100 may also be connected.

The controller 150 causes the image forming apparatus 100 to form the image by controlling the respective portions of the image forming apparatus 100 on the basis of information on a job. The job information includes a start instruction (start signal) and information (instruction signal) on a printing operation condition such as a kind of the recording material P, which are inputted from the operating portion 160 or the external device 200. Incidentally, information on the kind of the recording material (this information is also simply referred to as "information on the recording material" encompasses arbitrary pieces of information capable of discriminating the recording material, inclusive of attributes (so-called paper kind categories) based on general features such as plain paper, quality paper, coated paper, embossed paper, thick paper and thin paper, numerals and numerical ranges such as a basis weight, a thickness and a size, and brands (including manufactures, product numbers and the like). In this embodiment, the information on the kind of the recording material P includes information on the kind of the recording material P relating to the rigidity of the recording material P, particularly information on the basis weight of the recording material P as an example. In the case where the information on the printing operation condition is inputted from the operating portion 160, the operating portion 160 functions as an inputting portion for inputting to the controller 150, the information on the basis weight of the recording material P onto which the toner image is transferred. Further, in the case where the information on the printing operation condition is inputted from the external device 200 such as the personal computer, the interface portion 153 functions as the inputting portion for inputting, to the controller 150, the information on the basis weight of the recording material P onto which the toner image is transferred.

In this embodiment, specifically, to the controller 150, job information is inputted from the external device 200 or the like through an unshown controller (video controller) is inputted. The controller 150 analyzes the job information and inputs information on a printing operation condition and image information (video signal) developed into bit map data. The controller 150 effects integrated control on the basis of the information on the printing operation condition and the image information which are inputted from the (video) controller. In this embodiment, when the controller 150 receives a job start instruction (printing start command) from the (video) controller, the controller 150 outputs a/TOP signal and a/BD signal which provide reference timings of output of video signals, to the controller. The/TOP signal is a signal which constitutes a reference signal with respect to a sub-scan direction when the video signal is outputted, and the BD signal is a signal which constitutes a reference signal with respect to a main scan direction when the video signal is outputted. That is, every time when the/TOP signal is inputted, output of the video signal for printing the image a new page (sheet) is started. Further, every time when the /BD signal is inputted, output of the video signal corresponding to one line with respect to the main scan direction is started. Thus, the/TOP signal corresponds to a synchronizing signal with respect to the sub-scan direction when the image is formed, and image formation by an image controller 10 is started depending on this/TOP signal.

In this embodiment, at a timing when the job start instruction is inputted from the (video) controller to the controller 150 (at a timing when the (video) controller outputs the job start instruction to the controller 150), the recording material P accommodated in the recording material accommodating portion 11 is fed by the feeding roller 19. This recording material P is further fed toward the secondary transfer nip N2 by the registration rollers 13. Then, when the leading end of the recording material P is detected by the registration sensor 18, the registration rollers 13 are temporarily caused to be at rest, so that the recording material P is in a stand-by state. Further, the controller 150 outputs the/TOP signal to the (video) controller in synchronism with a detection signal of the leading end of the recording material P outputted from the registration sensor 18. The (video) controller outputs the image information to the controller 150 in synchronism with the/TOP signal. Then, the controller 150 starts exposure by the exposure device 3 depending on the image information. Further, the controller 150 causes the registration rollers 13 to start (resume) the rotational drive, so that the registration rollers 13 feeds the recording material P, which is in the stand-by state, to the secondary transfer nip N2. In this embodiment, the/TOP signal is generated on the basis of the detection signal of the registration sensor 18, but is not limited thereto, and may only be required to be formed so as to be used as a reference timing signal of a start of an image forming step. That is, in this embodiment, generation timing of the/TOP signal can be regarded as a start timing of the image forming step (i.e., an image writing timing of the image forming means), specifically as an exposure start timing of the exposure device 3. This exposure start timing of the exposure device 3 corresponds to a leading end writing timing of the image during formation of a whole-surface solid image (image of a maximum density level in an entire image forming region) on a single recording material P.

Here, the image forming apparatus 100 executes a job (printing job, print job) which is a series of operations which is started by a single start instruction and in which the image is formed and outputted on a single recording material P or a plurality of recording materials P. The job includes an image forming step (printing operation, print operation, image forming operation), a pre-rotation step, a sheet (paper) interval step in the case where the images are formed on the plurality of recording materials P, and a post-rotation step is general. The image forming step is performed in a period in which formation of an electrostatic image for the image actually formed and outputted on the recording material P, formation of the toner image, primary transfer of the toner image and secondary transfer of the toner image are carried out. The pre-rotation step is performed in a period in which a preparatory operation, before the image forming step, from an input of the start instruction until the image is started to be actually formed. The sheet interval step is performed in a period corresponding to an interval between a recording material P and a subsequent recording material P when the images are continuously formed on a plurality of recording materials P (continuous image formation). The post-rotation step is performed in a period in which a post-operation (preparatory operation) after the image forming step is performed. During non-image formation (non-image formation period) is a period other than the period of the image formation and includes the periods of the pre-rotation step, the sheet interval step, the post-rotation step and further includes a period of a pre-multi-rotation step which is a preparatory operation during turning-on of a main switch (voltage source) of the image forming apparatus 100 or during restoration from a sleep state. Incidentally, the shape state (rest state) is a state is, for example, a state in which supply of electric power to the respective portions, of the image forming apparatus 100, other than the controller 150 (or a part thereof) is stopped and electric power consumption is made smaller than electric power consumption in the stand-by state. In this embodiment, during the non-image formation, the offset mechanism 101 performs an operation of changing the offset amount by changing the position of at least one of the inner roller 26 and the outer roller 41 (particularly the inner roller 26 in this embodiment) (this operation is also referred to as an "offset operation").

6. Control Procedure

FIG. 7 is a flowchart showing an outline of an example of a control procedure of the job in this embodiment. In this embodiment, the case where a single job for forming an image on a single recording material P from a state in which the inner roller 26 is in the home position and the offset amount X is the first offset amount X1 will be described. Further, in this embodiment, the case where the operator causes the image forming apparatus 100 to execute the job through the operating portion 160 will be described as an example. Incidentally, FIG. 7 shows the outline of the control procedure in which the offset operation and a change in registration ON timing are noticed, and other many operations needed in general to output the image by executing the job are omitted.

First, when the operator sets the job by operating the operating portion 160, information thereof is notified to the controller 150. The controller 150 causes the image forming apparatus 100 to start the job by providing an instruction to the respective portions of the image forming apparatus 100 on the basis of the information (S101). The job information sent to the controller 150 includes the information on the kind of the recording material P. In this embodiment, the information on the kind of the recording material P includes at least the information on the basis weight of the recording material P. The information on the kind of the recording material P may also include, in addition to the information on the basis weight of the recording material P, pieces of information such as information on a surface property of the recording material P and information on an electric resistance value. Incidentally, the controller 150 is capable of acquiring the information on the kind of the recording material P directly inputted (also including selection from a plurality of choices) from the operating portion 160 (or the external device 200) through the operation by the operator. Further, the controller 150 is also capable of acquiring information on the kind of the recording material P, on the basis of the information on the recording material accommodating portion 11 for feeding the recording material P in the job, inputted from the operating portion 160 (or the external device 200) through the operation by the operator. In this case, the controller 150 is capable of acquiring the information on the kind of the recording material P from the pieces of information on the kinds of the recording materials P stored in the memories 152 associated in advance with the plurality of the recording material accommodating portions 11, respectively. Here, when the information on the kind of the recording material P is registered, an associated one may also be selected from a list of the kinds of the recording materials P stored in the memories 152 or a storing device connected to the controller 150 through a network in advance.

When the controller 150 acquires the information on the kind of the recording material P used in the job, the controller 150 sets the printing operation condition of the job at a printing operation condition predetermined every kind of the recording material P. A table 1 shows an example of settings of the offset amount X and the registration ON timing which are preset depending on the basis weight of the recording material P as the printing operation condition in this embodiment. Pieces of information on the printing operation condition as shown in the table 1 are stored in advance in the memories 152.

TABLE 1

| BW*1 [gsm] | OA*2 [mm] | ROT*3 [s] |
|---|---|---|
| 81 | +2.5 | Rt1 |
| 350 | −1.0 | Rt1 +3.54 × $10^{-3}$ |

*1"BW" is the basis weight.
*2"OA" is the offset amount.
*3"ROT" is the registration ON timing.

Next, when the controller 150 acquires job information in S101, the controller 150 discriminates whether or not the basis weight of the recording material P used in the job is 300 gsm or less (S102). In the case where the controller 150 discriminated in S102 that the basis weight is 300 gsm or less, the controller 150 does not change the offset amount X and starts a printing operation (S103). This is because in this case, the offset amount X may be kept at +2.5 mm (first offset amount×1) which is default (value) corresponding to the home position of the inner roller 26. Then, the controller 150 ends the printing operation after the printing operation corresponding to a predetermined number of printing sheets set by the operator is completed (S104), and then ends the job (S105).

On the other hand, in the case where the controller 150 discriminated in S102 that the basis weight is larger than 300 gsm, the following sequence is performed. That is, the controller 150 provides an instruction to the offset mechanism 101 (specifically the offset cam driving motor 101*a*) and thus turns on drive of the offset mechanism 101, so that the controller 150 changes the offset amount X to −1.0 mm (second offset amount X2) (S106). Thereafter, the controller 150 provides an instruction to the offset member 101 and thus turns off the drive of the offset mechanism 101 (S107). Then, the controller 150 changes setting in the memory 152 so as to change the registration ON timing to Rt1+3.54×$10^{-3}$ (S108). Thereafter, the controller 150 starts the printing operation (S109), and then ends the printing operation after the printing operation of images on a predetermined number of sheets set by the operator for the printing operation is completed (S110). After the end of the printing operation, the controller 150 sends an instruction to the offset mechanism 101 and turns on drive of the offset mechanism 101, so that the controller 150 changes the offset amount X to +2.5 mm (first offset amount X1) (S111). Thereafter, the controller 150 sends an instruction to the offset mechanism 101 and turns off the drive of the offset mechanism 101 (S112). Further, the controller 150 returns the setting of the registration ON timing in the memory 152 to Rt1 which is the default (S113) and then ends the job (S105).

In the control procedure of FIG. 7, the job for forming the image on the single recording material P is described as an example. In the case where in a continuous image forming job for continuously forming images on a plurality of recording materials P, the kind of the recording material P is changed during the job and there is a need to change the offset amount X, the following may only be required to be performed. That is, in the sheet interval step, the offset amount X is changed and then depending on the changed offset amount X, the registration ON timing may only be required to be changed.

Here, the offset amount X may only be required to be a desired offset amount X when the recording material P passes through the secondary transfer nip N2 (during the secondary transfer). That is, the change in offset amount X is made so as to be completed before the recording material P on which the image is formed with the changed offset amount X reaches the secondary transfer nip N2. Typically, the change in offset amount X is executed so as to be completed before feeding of the recording material S by the registration roller 13 or feeding of the recording material P from the recording material accommodating portion 11 is started. Further, the registration ON timing may only be required to be a desired value when feeding of the recording material P from the registration rollers 13 is started. That is, the change in registration ON timing is made so as to be completed before the recording material P fed at the changed registration ON timing reaches the registration rollers 13. Typically, the change in registration ON timing (the change in setting) is executed so as to be completed before the feeding of the recording material P from the recording material accommodating portion 11 is started.

Further, in this embodiment, the case where the registration ON timing when the offset amount X is the first offset amount X1 is the default is described as an example. For that reason, in the case where the offset amount X is the second offset amount X2, the registration ON timing is made later than the default. By this, a time from the exposure start timing of the exposure device 3 to the registration ON timing is longer in the case where the offset amount X is the second offset amount X2 than in the case where the offset amount X is the first offset amount X1. On the other hand, the registration ON timing when the offset amount X is the second offset amount X2 may also be used as the default. In that case, when the offset amount X is the first offset amount X1, the registration ON timing is made earlier than the default.

Further, in this embodiment, the feeding speed of the recording material P by the registration rollers 13 is constant, but the image forming apparatus 100 may also be capable of image formation (secondary transfer) in a plurality of modes different in feeding speed (process speed) of the recording material P by the registration rollers 13. In this case, the registration ON timing with respect to the feeding speed of the belt 21 may only be required to be changed so as to cancel ($\Delta R(X2)-\Delta R(X1)$) which is a leading end misregistration amount occurring depending on the offset amount X. That is, a value obtained by dividing, by the feeding speed of the belt 21, a time difference from the image writing timing (exposure start timing) of the exposure device to a timing when the registration rollers 13 starts (presumes) the feeding of the recording material P may only be required to be changed depending on the offset amount X.

7. Effect

Thus, in this embodiment, the image forming apparatus 100 includes the image forming means 10 for forming the toner image, the rotatable endless belt 21 for feeding the toner image which is formed by the image forming means 10 and which is carried at the image forming position N1, the plurality of the stretching rollers including the inner roller 26, the outer roller 41 disposed opposed to the inner roller 26 and for forming the transfer portion N2 where the toner image is transferred from the belt 21 onto the recording material P in contact with the outer peripheral surface of the belt 21, the position changing mechanism 101 for changing the relative position between the inner roller 26 and the outer roller 4 with respect to the circumferential direction of the inner roller 26 to the first relative position and the second relative position different from the first relative position by changing the position of at least one of the inner roller 26 and the outer roller 41, the feeding member 13 for feeding the recording material P to the transfer portion N2, and the feeding member (means) driving portion 114 for driving the feeding member 13. Further, in this embodiment, the image forming apparatus 100 further includes the controller 150 capable of executing the control in which in the formation of the image on a single recording material P, the time from the image writing timing of the image forming means 10 to the feeding start timing of the recording material P by the feeding member 13 is changed between the case where the transfer is carried out at the first relative position as the above-described relative position and the case where the transfer is carried out at the second relative position as the above-described relative position. Incidentally, as regards the time from the image writing timing of the image forming means 10 to the feeding start timing of the recording material P by the feeding member 13, typically, in a job executed in each of the case where the above-described relative position is the first relative position and the case where the above-described relative position is the second relative position, the time from the image writing timing of the image formed on a first recording material P (sheet) to the feeding start timing of the recording material P by the feeding member 13 may only be required to be compared.

Here, in the above-described control, the controller 150 changes the above-described time so that a degree of the positional deviation between the image forming region on the belt and the image forming region on the recording material P with respect to the feeding direction of the recording material P becomes smaller than the degree of the position deviation in the case where the above-described time is not changed between the case where the transfer is carried out at the first relative position as the above-described relative position and the case where the transfer is carried out at the second relative position as the above-described relative position. Particularly, in this embodiment, the above-described plurality of stretching rollers include the tension roller 24 disposed downstream of the image forming position N1 and upstream of the inner roller 26 with respect to the rotational direction of the belt 21 and for imparting tension to the belt 21, the position changing mechanism 101 changes the above-described relative position to between the first relative position and the second relative position by changing the position of the inner roller 26, the inner roller 26 is positioned on the side downstream of the outer roller 41 with respect to the rotational direction of the belt 21 in the case of the first relative position than in the case of the second relative position, and the controller 150 changes the above-described time in the above-described control so that the above-described time in the case where the transfer is carried out at the second relative position as the above-described relative position is longer than the above-described time in the case where the transfer is carried out at the first relative position as the above-described rotational direction. Further, in this embodiment, the position changing mechanism 101 changes the offset amount X between the first offset amount X1 in the case of the relative position and the second offset amount X2 in the case of the second relative position, and the first offset amount X1 is a positive value and the second offset amount X2 is 0 or a negative value. In this embodiment, the controller 150 changes the above-described time in the above-described control by controlling the feeding member driving portion 114 so as to change the feeding start timing of the recording material P by the feeding member 13. Further, in this embodiment, the image writing timing of the image forming means 10 is the exposure start timing of the exposure means 3 provided in the image forming means 10 and for forming the electrostatic image. Further, in this embodiment, the belt 21 is the intermediary transfer member for feeding the toner image, primary-transferred from the image bearing member 1 provided on the image forming means 10, in order to secondary-transfer the toner image onto the recording material P at the transfer portion N2.

As described above, in this embodiment, the offset amount X is changed depending on the basis weight of the recording material P as the information on the kind of the recording material P. Further, in this embodiment, in the case where the offset amount X is changed, the registration ON timing is changed depending on the offset amount X. In other words, in this embodiment, not only the offset amount X is changed depending on the basis weight of the recording material P as the information on the kind of the recording material P, but also the registration ON timing is changed depending on the basis weight of the recording material P as the information on the kind of the recording material P. By this, deviation of the leading end registration position caused by the change in offset amount X is corrected, so that occurrence of the leading end misregistration can be suppressed. Accordingly, according to this embodiment, not only improvement in transfer property of the toner image onto each of the recording materials of the plurality of kinds can be realized by changing the offset amount X, but also it is possible to suppress the occurrence of the leading end misregistration due to the change of the offset amount X. That is, according to this embodiment, it becomes possible to suppress the leading end misregistration in the secondary transfer nip while meeting the medium with a side variety of values of rigidity.

In this embodiment, the controller 150 controlled the elapsed time from generation of the/TOP signal as the predetermined reference timing until the rotational drive of the registration rollers 13 is started (resumed), but is not limited thereto. For example, a leading end registration patch for image leading end registration adjustment may also be formed on the belt 21 for causing the image leading end position and the recording material position to coincide with each other. Further, this leading end registration patch is detected by the registration sensor and the registration ON timing may also be controlled on the basis of the detection timing of the registration sensor. The registration sensor can be disposed so as to oppose the belt 21 on a side immediately upstream of the transfer portion N2 with respect to the rotational direction of the belt 21. Further, the leading end registration patch may also be formed in a non-image region (sheet interval) disposed in every page on a leading end side of an associated image, and a constitution in which the registration ON timing is controlled on the basis of the detection timing of the registration sensor for each of the pages may also be employed. Further, also, in such a constitution that the registration ON timing is controlled by the leading end registration patch, a constitution in which the registration ON timing is changed depending on the offset amount X may also be employed. That is, the controller 150 may also control the change of the offset amount X and the registration ON timing on the basis of the detection timing of the leading end registration patch and the information on the kind of the recording material P.

Embodiment 2

Next, another embodiment of the present invention will be described. Basic constitutions and operations of an image forming apparatus in this embodiment are the same as those of the image forming apparatus in the embodiment 1. Accordingly, elements having the same or corresponding functions or constitutions as those in the embodiment 1 are represented by the same reference numerals or symbols as those in the embodiment 1 and will be omitted from detailed description.

1. Outline of this Embodiment

In the embodiment 1, the deviation of the leading end registration position with the change of the offset amount X was corrected by changing the feeding start timing (registration ON timing) of the recording material P by the registration rollers 13.

On the other hand, in this embodiment, the deviation of the leading end registration position with the change of the offset amount X is corrected by changing the image leading end position by changing the image writing timing (exposure start timing) of the exposure device 3. In this embodiment, the controller 150 functions as an image writing timing changing means and changes the image writing timing of the exposure device 3. The change amount of the registration ON timing described in the embodiment 1 can be read as a change amount of the image writing timing in this embodiment.

Incidentally, in this embodiment, the case where the image writing timing when the offset amount X is the first offset amount X1 is the default is described as an example. For that reason, in the case where the offset amount X is the second offset amount X2, the image writing timing is made earlier than the default. By this, a time from the exposure start timing of the exposure device 3 to the registration ON timing is longer in the case where the offset amount X is the second offset amount X2 than in the case where the offset amount X is the first offset amount X1. On the other hand, the image writing timing when the offset amount X is the second offset amount X2 may also be used as the default. In that case, when the offset amount X is the first offset amount X1, the image writing timing is made later than the default. Thus, the time from the exposure start timing of the exposure device 3 to the registration ON timing can be changed also by changing the image writing timing of the exposure device 3.

Further, in this embodiment, the feeding speed of the recording material P by the registration rollers 13 is constant, but the image forming apparatus 100 may also be capable of image formation (secondary transfer) in a plurality of modes different in feeding speed of the recording material P by the registration rollers 13.

2. Control Procedure

FIG. 8 is a flowchart showing an outline of an example of a control procedure of a job in this embodiment. Processes of S201 to S213 in the control procedure of FIG. 8 are similar to the processes of S101 to S113, respectively, in the control procedure of FIG. 7. However, in this embodiment, in S208, the controller 150 changes the setting of the image writing timing in the memory 152. Further, in this embodiment, in S213, the controller 150 returns the setting of the image writing timing in the memory 152 to the default.

A table 2 shows an example of setting of the offset amount and the image writing timing which are determined in advance as a printing operation condition depending on the basis weight of the recording material P in this embodiment. Pieces of information on the printing operation condition as shown in the table 2 are stored in the memory 152 in advance.

Incidentally, in order to secondary-transfer the toner image onto the recording material P in a predetermined position, the image writing timing is represented by a time required from a start timing of the job to a start timing of the image forming step (the image writing timing of the exposure device 3). In this embodiment, specifically, the image writing timing is represented by an elapsed time from input of a start instruction (printing start command) of the job to the controller 150 until the controller 150 generates the/TOP signal. In this embodiment, this time under a condition of the case where the offset amount X is the first offset amount X1 is It1(s) (first time, first timing) and is referred to as an image writing timing of the case of the first offset amount X1. Further, an image writing timing (second time, second timing) of the case of the second offset amount X2 is represented by using the above-described It1 as a reference value. Here, the image writing timing is compared in the case where a process in a pre-rotation step executed in a period from the job start instruction to generation of the/TOP signal is substantially the same. For example, the process in the pre-rotation step executed periodically or depending on an operator's instruction is different, so that even under the condition of the same offset amount X, the image writing timing based on the job start instruction can be different.

TABLE 2

| BW*1 [gsm] | OA*2 [mm] | IWT*3 [s] |
|---|---|---|
| 81 | +2.5 | It1 |
| 350 | −1.0 | It1 −3.54 × $10^{-3}$ |

*1"BW" is the basis weight.
*2"OA" is the offset amount.
*3"IWT" is the image writing timing.

In the control procedure of FIG. 8, the job for forming the image on the single recording material P was described as an example. In the case where in a continuous image forming job for continuously forming images on a plurality of recording materials P, the kind of the recording material P is changed during the job and there is a need to change the offset amount X, the following may only be required to be performed. That is, in the sheet interval step, the offset amount X is changed and then depending on the changed offset amount X, the image writing timing may only be required to be changed.

3. Effect

Thus, in this embodiment, the controller 150 changes the above-described time by controlling the image forming means so as to change the image writing timing of the image forming means in control in which in formation of the image on a single recording material P, a time from the image writing timing of the image forming means 10 to the feeding start timing of the recording material P by the feeding member 13 is changed between the case where the transfer is carried out at the first relative position as the relative position between the inner roller 26 and the outer roller 41 and the case where the transfer is carried out at the second relative position as the relative position between the inner roller 26 and the outer roller 41. In this embodiment, the image writing timing of the image forming means 10 is the exposure start timing of the exposure means 3 provided in the image forming means 10 and for forming the electrostatic image.

As described above, in this embodiment, the offset amount X is changed depending on the basis weight of the recording material P as the information on the kind of the recording material P. Further, in this embodiment, in the case where the offset amount X is changed, the image writing timing of the exposure device 3 is changed depending on the offset amount X. In other words, in this embodiment, not only the offset amount X is changed depending on the basis weight of the recording material P as the information on the kind of the recording material P, but also the image writing timing of the exposure device 3 is changed depending on the basis weight of the recording material P as the information on the kind of the recording material P. By this, deviation of the leading end registration position caused by the change in offset amount X is corrected, so that occurrence of the leading end misregistration can be suppressed. Accordingly, according to this embodiment, not only improvement in transfer property of the toner image onto each of the recording materials of the plurality of kinds can be realized by changing the offset amount X, but also it is possible to suppress the occurrence of the leading end misregistration due to the change of the offset amount X.

Other Embodiments

The present invention was described above based on specific embodiments, but is not limited thereto.

In the above-described embodiments, the constitution in which Ld (=Ld1) in the case where the inner roller 26 is in the position of the first offset amount X1 is longer than Ld (=Ld2) in the case where the inner roller 26 is in the position of the second offset amount X2 (Ld1>Ld2). However, the case of Ld1<Ld2 may also be employed. Further, in the case where a magnitude relationship of the above-described difference with respect to the offset amount (position) is reversed, the time from the image writing timing to the feeding start timing may also be made longer in the case of the first offset amount X1 than in the case of the second offset amount X2. That is, in the case where the leading end misregistration occurs with at least the change in offset amount, the time difference from the image writing timing to the feeding start timing may only be required to be changed depending on each of offset amounts for the belt feeding speed so as to suppress the leading end misregistration. That is, a storing portion in which information on the time from the image writing timing to the feeding start timing is stored depending on the offset amount is provided in advance. Then, the controller may only be required to control the time difference from the image writing timing for the belt feeding speed to the feeding start timing on the basis of the information stored in the storing portion.

Further, in this embodiment, the registration ON timing offset amount (=(Rt(X2)−Rt(X1)) with the change in offset position was stored in advance as table information which is a fixed value, but the present invention is not limited thereto. In the case where the leading end misregistration receives the influence of individual variation of the apparatus, a constitution in which the registration ON timing offset amount (=(Rt(X2)−Rt(X1)) is acquired every apparatus may also be employed. For example, a well-known test chart for leading end registration adjustment is outputted at each of the offset positions, so that the registration ON timing is adjusted at each position. Further, on the basis of an adjustment result at each offset position, the registration ON timing offset amount (=(Rt(X2)−Rt(X1)) may also be renewed.

In the above-described embodiments, the constitution in which, the offset amount is changed by changing the position of the inner roller is employed, but a constitution in which the offset amount J changed by changing the position of the outer roller may also be employed. Further, the present invention is not limited to a constitution in which either one of the inner roller and the outer roller is moved but may also employ a constitution in which the offset amount is changed by moving both the inner roller and the outer roller.

Here, for example, in a constitution such that the offset amount is changed by moving the outer roller, reverse to the above-described embodiments, the above-described length Lt becomes shorter in the case where the outer roller is positioned relatively on the side upstream of the inner roller with respect to the rotational direction of the intermediary transfer belt than in the other case in some instances. In this case, the registration ON timing and the image writing timing with respect to the relative position between the inner roller and the outer roller may only be required to provide a relationship opposite to the relationship in the above-described embodiments (these timings are made early in the case where the timings are made later in the above-described embodiments, and are made late in the case where the timings are made early).

In the above-described embodiments, the constitution in which the tension roller is provided between the primary transfer nip to the secondary transfer nip with respect to the rotational direction of the intermediary transfer belt was described as an example. In this constitution, as described above, a travelling distance of the intermediary transfer belt from the tension roller to the secondary transfer nip is liable to change due to the change in offset amount, and therefore, an effect of the present invention can be obtained particularly considerably. However, even when such a constitution is not employed, in the case where the control according to the present invention is not carried out, there is a possibility that the leading end registration position is deviated by the change in position of the secondary transfer portion with respect to the rotational direction of the intermediary transfer belt by changing the offset amount. Accordingly, the present invention is capable of effectively acting on such a constitution. That is, in the constitution in which the length from the image forming position to the transfer portion with respect to the rotational direction of the belt is changed by the change in offset amount, it is possible to achieve the effects of the above-described embodiments by applying the present invention to the constitution.

In the above-described embodiments, as an outer member for forming the secondary transfer nip in cooperation with the inner roller as an inner member, the outer roller directly contacting the outer peripheral surface of the intermediary transfer belt was used. On the other hand, a constitution in which as the outer member, the outer roller and a secondary transfer belt stretched by the outer roller and other rollers are used may also be employed. That is, the image forming apparatus may include, as the outer member, the stretching rollers, the outer roller and the secondary transfer belt stretched between these rollers. Further, the secondary transfer roller is contacted to the outer peripheral surface of the intermediary transfer belt by the outer roller. In such a constitution, by the inner roller contacting the inner peripheral surface of the intermediary transfer belt and the outer roller contacting the inner peripheral surface of the secondary transfer belt, the intermediary transfer belt and the secondary transfer belt are sandwiched, so that the secondary transfer nip is formed. In this case, a contact portion between the intermediary transfer belt and the secondary transfer belt is the secondary transfer nip as the secondary transfer portion. Incidentally, also in this case, the offset amount X is defined by the relative position between the inner roller and the outer roller similarly as described above.

In the above-described embodiments, as the information on the kind of the recording material relating to the rigidity of the recording material was used, but the present invention is not limited thereto. In the case where a paper kind category (for example, plain paper and coated paper which are the paper kind categories based on a surface property) or a brand (including a manufacturer, a product number or the like) is the same, the basis weight of the recording material and the thickness of the recording material are in a substantially proportional relationship in many instances (in which the basis weight is larger with an increasing thickness). Further, in the case where the paper kind category or the brand is the same, the present invention of the recording material, and the basis weight or the thickness of the recording material are in a substantially proportional relationship in many instances (in which the rigidity is larger with an increasing basis weight or thickness). Accordingly, for example, the offset amount can be set on the basis of the basis weight, the thickness or the rigidity of the recording material for each of the paper kind categories, the brands or combinations of the paper kind category and the brand. Further, the controller is capable of causing the offset mechanism to operate so as to provide the offset amount depending on the recording material, on the basis of information on the paper kind category, the brand and the like which are inputted from the operating portion and the external device and on the basis of the basis weight, the thickness, the rigidity and the like of the recording material. Further, the present invention is not limited to use of, as the information on the kind of the recording material, quantitative information on, for example, the basis weight, the thickness or the rigidity. As the information on the kind of the recording material, for example, only qualitative information on the paper kind category, the brand or a combination of the paper kind category and the brand can be used. For example, the offset amount is set depending on the paper kind category, the brand or a combination of the paper kind category and the brand, and then the controller is capable of determining the offset amount depending on the information on the paper kind category, the brand and the like which are inputted from the operating portion, the external device or the like. Also, in this case, the offset amount is assigned on the basis of a difference in rigidity between the recording materials. Incidentally, the rigidity of the recording material can be represented by Gurley rigidity (stiffness) (MD/long fold) [mN] and can be measured by a commercially available Gurley stiffness tester.

In the above-described embodiments, description of the controller was made that the controller acquires the information in the kind of the recording material on the basis of the input thereof from the operating portion or the external device through the operation by the operator, but the controller may also acquire the information on the kind of the recording material on the basis of the input of a detection result of the detecting means. For example, a basis weight sensor can be used as a basis weight detecting means for detecting an index value correlating with the basis weight of the recording material. As the basis weight sensor, for example, a basis weight sensor utilizing attenuation of ultrasonic wave has been known. This basis weight sensor includes an ultrasonic generating portion and an ultrasonic receiving portion which are provided so as to sandwich a recording material feeding passage. The basis weight sensor generates the ultrasonic wave from the ultrasonic generating portion and receives the ultrasonic wave attenuation by being passed through the recording material, and then on the basis of attenuation amount of the ultrasonic wave, detects the index value correlating with the basis weight of the recording material. Incidentally, the basis weight detecting means may only be required to be capable of detecting the index value correlating with the basis weight of the recording material and is not limited to the basis weight detecting means utilizing the ultrasonic wave, but may also be a basis weight detecting means utilizing light, for example. The index value correlating the basis weight of the recording material is not limited to the basis weight itself, but may also be a thickness corresponding to the basis weight. Further, a surface property sensor can be used as a smoothness detecting means for detecting an index value correlating with surface smoothness of the recording material capable of being utilized for detecting the paper kind category. As the surface property sensor, a regularly/irregularly reflected light sensor for reading intensity of regularly reflected light and irregularly reflected light by irradiating the recording material with light has been known. In the case where the surface of the recording material is smooth, the regularly reflected light becomes strong, and in the case where the surface of the recording material is rough, the irregularly reflected light becomes strong. For that reason, the surface property sensor is capable of detecting the index value corresponding with the smoothness of the recording material surface by measuring a regularly reflected light quantity and an irregularly reflected light quantity. Incidentally, the smoothness detecting means may only be required to be capable of detecting the index value correlating with the smoothness of the recording material surface and is not limited to the above-described smoothness detecting means using the light quantity sensor, but may also be a smoothness detecting means using, for example, an image-pick up element. The index correlating the smoothness of the recording material surface is not limited to a value converted to a value in conformity to a predetermined standard such as Bekk smoothness, but may only be required to be a value having a correlation with the smoothness of the recording material surface. These detecting means can be disposed adjacent to the recording material feeding passage on a side upstream of the recording material rollers with respect to the recording material feeding direction, for example. Further, for example, a detecting means (media sensor) constituted as a single voltage including the above-described basis weight sensor, the surface property sensor, and the like.

In the above-described embodiments, as the small, an actuator for actuating the movable portion by the cam was used, but the offset mechanism is not limited thereto. The offset mechanism may only be required to be capable of realizing an operation in conformity to each of the above-described embodiments, and for example, an actuator for actuating the movable portion by using a solenoid, for example.

Further, in the above-described embodiments, the case where the belt-shaped image bearing member was the intermediary transfer belt was described, but the present invention is applicable when an image bearing member constituted by an endless belt for feeding the toner image borne at the image forming position is used. Examples of such a belt-shaped image bearing member may include a photosensitive (member) belt and an electrostatic recording dielectric (member) belt, in addition to the intermediary transfer belt in the above-described embodiments.

Further, the present invention can be carried out also in other embodiments in which a part or all of the constitutions of the above-described embodiments are replaced with alternative constitutions thereof. Accordingly, when the image forming apparatus using the belt-shaped image bearing member is used, the present invention can be carried out with no distinction as to tandem type/single drum type, a charging type, an electrostatic image forming type, a developing type, a transfer type and a fixing type. In the above-described embodiments, a principal part relating to the toner image formation/transfer was described principally, but the present invention can be carried out in various uses, such as a printers, various printing machines, copying machines, facsimile machines and multi-function machines, by adding necessary device, equipment and a casing structure.

According to the present invention, the occurrence of the leading end misregistration due to the change in offset amount can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-105704 filed on Jun. 18, 2020, which is hereby incorporated by reference herein in its entirety.

What is claimed is:

1. An image forming apparatus comprising:

an image bearing member configured to bear a toner image;

an image forming portion configured to form the toner image on the image bearing member;

an endless belt onto which the toner image formed on the image bearing member is transferred at a primary transfer portion;

a plurality of stretching rollers including an inner roller, the plurality of stretching rollers being configured to stretch the endless belt;

an outer roller configured to form a secondary transfer portion in cooperation with the inner roller where the toner image is transferred from the endless belt onto a recording material;

a position changing mechanism configured to move the inner roller to change a position of the secondary transfer portion with respect to a circumferential direction of the inner roller, the position changing mechanism being capable of changing a position of the inner roller to a plurality of positions including a first position and a second position positioned downstream of the first position with respect to a rotational direction of the endless belt;

a feeding member configured to feed the recording material to the secondary transfer portion;

a feeding member driving portion configured to drive the feeding member; and a controller configured to control the feeding member driving portion, wherein the control of the feed member driving portion by the controller depends on the position of the inner roller when the toner image is transferred to the recording material.

2. An image forming apparatus according to claim 1, wherein the controller is capable of executing an operation in a first image forming mode in which the inner roller is positioned at the first position and image formation is executed in a state which the endless belt rotates at a predetermined speed, and in a second image forming mode in which the inner roller is positioned at the second position and the image formation is executed in the state which the endless belt rotates at the predetermined speed, and wherein the controller controls the feeding member driving portion by a first control in the first image forming mode and controls the feeding member driving portion by a second control different from the first control in the second image forming mode.

3. An image forming apparatus according to claim 1, wherein the controller controls the feeding member driving portion so that a registration deviation amount occurring with a change in position of the inner roller is small or zero.

4. An image forming apparatus according to claim 1, wherein the controller controls the position of the inner roller during the transfer of the toner image onto the recording material on the basis of information on a kind of the recording material.

5. An image forming apparatus according to claim 1, wherein the controller controls a feeding start timing of the recording material by the feeding member depending on the position of the inner roller during transfer of the toner image onto the recording material.

6. An image forming apparatus according to claim 1, wherein the stretching rollers include a tension roller provided downstream of the primary transfer portion and upstream of the inner roller with respect to the rotational direction of the endless belt, the tension roller imparting tension to the endless belt.

7. An image forming apparatus according to claim 1, wherein the stretching rollers include an upstream roller provided upstream of and adjacent to the inner roller with respect to the rotational direction of the endless belt, wherein in a cross section substantially perpendicular to a rotational direction of the inner roller, a common tangential line between the inner roller and the upstream roller on a side where the endless belt is stretched is a reference line L1, a rectilinear line passing through a rotation center of the inner roller and substantially perpendicular to the reference line L1 is an inner roller center line L2, a rectilinear line passing through a rotational center of the outer roller and substantially perpendicular to the reference line L1 is an outer roller center line L3, and a distance between the inner roller center line L2 and the outer roller center line L3 is an offset amount X that is a positive value when the outer roller center line L3 is positioned upstream of the inner roller center line L2 with respect to the rotational direction of the endless belt, and wherein the position changing mechanism changes the offset amount X between a first offset amount X1 in a case of the first position and a second offset amount X2 in a case of the second position, the first offset amount X1 being a positive value and the second offset amount X2 being zero or a negative value.

8. An image forming apparatus according to claim 1, wherein the outer roller contacts an outer peripheral surface of the endless belt via another endless belt stretched by the outer roller and another roller.

9. An image forming apparatus according to claim 1, further comprising a guiding member provided upstream of the secondary transfer portion with respect to a recording material feeding direction, the guiding member being configured to guide the recording material to the secondary transfer portion.

10. An image forming apparatus according to claim 1, wherein the feeding member is a registration roller.

11. An image forming apparatus according to claim 1, wherein the feeding member is provided upstream of and adjacent to the secondary transfer portion.

12. An image forming apparatus according to claim 1, wherein the recording material is fed to the secondary transfer portion without once stopping the feeding after feed by the feeding member and until reaching the secondary transfer portion.

13. An image forming apparatus comprising:

an image bearing member configured to bear a toner image;

an image forming portion configured to form the toner image on the image bearing member;

an endless belt onto which the toner image formed on the image bearing member is transferred at a primary transfer portion;

a plurality of stretching rollers including an inner roller, the plurality of stretching rollers being configured to stretch the endless belt;

an outer roller configured to form a secondary transfer portion in cooperation with the inner roller where the toner image is transferred from the endless belt onto a recording material;

a position changing mechanism configured to move the inner roller to change a position of the secondary transfer portion with respect to a circumferential direction of the inner roller, the position changing mechanism being capable of changing a position of the inner roller to a plurality of positions including a first position and a second position positioned downstream of the first position with respect to a rotational direction of the endless belt;

a feeding member configured to feed the recording material to the secondary transfer portion;

a feeding member driving portion configured to drive the feeding member; and a controller configured to control a time difference from a predetermined reference timing to a feeding start timing of the recording material by the feeding member, wherein the time difference depends on the position of the inner roller during transfer of the toner image onto the recording material.

14. An image forming apparatus according to claim 13, wherein the controller is capable of executing an operation in a first image forming mode in which the inner roller is positioned in the first position and image formation is executed in a state which the endless belt rotates at a predetermined speed, and in a second image forming mode in which the inner roller is positioned in the second position and the image formation is executed in the state which the endless belt rotates at the predetermined speed, and wherein the controller controls the time difference to a first predetermined value in the first image forming mode and controls the time difference to a second predetermined value different from the first predetermined value in the second image forming mode.

15. An image forming apparatus according to claim 13, wherein the controller controls the time difference so that a registration deviation amount occurring with a change in position of the inner roller is small or zero.

16. An image forming apparatus according to claim 13, wherein the controller controls the position of the inner roller during the transfer of the toner image onto the recording material on the basis of information on a kind of the recording material.

17. An image forming apparatus according to claim 13, wherein the controller controls a feeding start timing of the recording material by the feeding member depending on the position of the inner roller during transfer of the toner image onto the recording material.

18. An image forming apparatus according to claim 13, wherein the image forming portion includes an exposure device for irradiating a surface of the image bearing member with laser light modulated depending on an image signal, and wherein the predetermined reference timing is an image writing start timing of the exposure device.

19. An image forming apparatus according to claim 18, wherein the controller controls the time difference by controlling the image writing start timing of the exposure device.

20. An image forming apparatus according to claim 13, wherein the image forming portion is configured to form a leading end registration patch for image leading end registration adjustment, and wherein the predetermined reference timing is a detection timing of the leading end registration patch.

21. An image forming apparatus according to claim 13, wherein the stretching rollers include a tension roller provided downstream of the primary transfer portion and upstream of the inner roller with respect to the rotational direction of the endless belt, the tension roller imparting tension to the endless belt.

22. An image forming apparatus according to claim 13, wherein the stretching rollers include an upstream roller provided upstream of and adjacent to the inner roller with respect to the rotational direction of the endless belt, wherein in a cross section substantially perpendicular to a rotational direction of the inner roller, a common tangential line between the inner roller and the upstream roller on a side where the endless belt is stretched is a reference line L1, a rectilinear line passing through a rotation center of the inner roller and substantially perpendicular to the reference line L1 is an inner roller center line L2, a rectilinear line passing through a rotational center of the outer roller and substantially perpendicular to the reference line L1 is an outer roller center line L3, and a distance between the inner roller center line L2 and the outer roller center line L3 is an offset amount X that is a positive value when the outer roller center line L3 is positioned upstream of the inner roller center line L2 with respect to the rotational direction of the endless belt, and wherein the position changing mechanism changes the offset amount X between a first offset amount X1 in a case of the first position and a second offset amount X2 in a case of the second position, the first offset amount X1 being a positive value and the second offset amount X2 being zero or a negative value.

23. An image forming apparatus according to claim 13, wherein the outer roller contacts an outer peripheral surface of the endless belt via another endless belt stretched by the outer roller and another roller.

24. An image forming apparatus according to claim 13, further comprising a guiding member provided upstream of the secondary transfer portion with respect to a recording material feeding direction, the guiding member being configured to guide the recording material to the secondary transfer portion.

25. An image forming apparatus according to claim 13, wherein the feeding member is a registration roller.

26. An image forming apparatus according to claim 13, wherein the feeding member is provided upstream of and adjacent to the secondary transfer portion.

27. An image forming apparatus according to claim 13, wherein the recording material is fed to the secondary transfer portion without once stopping the feeding after feed by the feeding member and until reaching the secondary transfer portion.

* * * * *